US009650059B2

(12) United States Patent
Cooper et al.

(10) Patent No.: US 9,650,059 B2
(45) Date of Patent: May 16, 2017

(54) SYSTEM AND METHOD FOR INSPECTING A ROUTE DURING MOVEMENT OF A VEHICLE SYSTEM OVER THE ROUTE

(71) Applicant: General Electric Company, Schenectady, NY (US)

(72) Inventors: Jared Klineman Cooper, Melbourne, FL (US); Mark Bradshaw Kraeling, Melbourne, FL (US); Eugene Smith, Melbourne, FL (US); James Glen Corry, Melbourne, FL (US); David Lowell McKay, Melbourne, FL (US); Brian Joseph McManus, Fort Worth, TX (US); Keith Szewczyk, Melbourne, FL (US); Joseph Forrest Noffsinger, Lee's Summit, MO (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/864,243

(22) Filed: Sep. 24, 2015

(65) Prior Publication Data

US 2016/0009300 A1 Jan. 14, 2016

Related U.S. Application Data

(63) Continuation of application No. 14/152,159, filed on Jan. 10, 2014, now Pat. No. 9,205,849, which is a (Continued)

(51) Int. Cl.

*B61K 9/08* (2006.01)
*B61L 23/04* (2006.01)

(Continued)

(52) U.S. Cl.

CPC ..... *B61K 9/08* (2013.01); *B61L 3/121* (2013.01); *B61L 23/04* (2013.01); *B61L 23/044* (2013.01);

(Continued)

(58) Field of Classification Search

CPC B61K 9/10; B61K 9/08; B61L 23/044; B61L 23/047; B61L 23/048;

(Continued)

(56) References Cited

U.S. PATENT DOCUMENTS 3,835,950 A 9/1974 Asano et al.
4,442,988 A 4/1984 Laurent et al.

(Continued)

FOREIGN PATENT DOCUMENTS

CN 1451148 A 10/2003
CN 1740020 A 3/2006

(Continued)

OTHER PUBLICATIONS

McCartney et al., "Redundancy in measurement systems", World Pipelines, pp. 27-30, Feb. 2003.

(Continued)

*Primary Examiner* — Redhwan K Mawari
*Assistant Examiner* — Edward Torchinsky
(74) *Attorney, Agent, or Firm* — John A. Kramer; Global Patent Operation

(57) ABSTRACT

A sensing system includes a leading sensor, a trailing sensor, and a route examining unit. The leading sensor is onboard a first vehicle of a vehicle system that is traveling along a route. The leading sensor measures first characteristics of the route as the vehicle system moves along the route. The trailing sensor is disposed onboard a second vehicle of the vehicle system. The trailing sensor measures second characteristics of the route as the vehicle system moves along the (Continued)

route. The route examining unit is disposed onboard the vehicle system and receives the first characteristics of the route and the second characteristics of the route to compare the first characteristics with the second characteristics. The route examining unit also identifies a segment of the route as being damaged based on a comparison of the first characteristics with the second characteristics.

23 Claims, 11 Drawing Sheets

Related U.S. Application Data continuation-in-part of application No. 13/478,388, filed on May 23, 2012, now abandoned.

(51) Int. Cl.
*B61L 3/12* (2006.01)
*B61L 99/00* (2006.01)
*B61L 15/00* (2006.01)
*B61L 25/02* (2006.01)

(52) U.S. Cl.
CPC ..... *B61L 23/045* (2013.01); *B61L 99/00* (2013.01); *B61L 15/0036* (2013.01); *B61L 25/025* (2013.01); *B61L 2205/04* (2013.01)

(58) Field of Classification Search
CPC .... B61L 15/0036; B61L 23/045; B61L 3/121; B61L 2205/04; B61L 25/025
See application file for complete search history.

(56) References Cited

U.S. PATENT DOCUMENTS 4,582,280 A 4/1986 Nichols et al.
4,700,223 A * 10/1987 Shoutaro ..... G01C 7/04 348/148
4,700,574 A 10/1987 Turbe
4,779,095 A * 10/1988 Guerreri ..... B60K 31/0008 180/169
5,075,772 A * 12/1991 Gebel ..... G01C 7/04 348/135
5,530,328 A 6/1996 Fernandez et al.
5,586,130 A 12/1996 Doyle
6,064,428 A * 5/2000 Trosino ..... B61L 23/044 348/128
6,108,732 A 8/2000 Klein
6,125,311 A 9/2000 Lo
6,128,559 A 10/2000 Saitou et al.
6,273,521 B1 * 8/2001 Halvorson ..... B60T 7/22 303/3
6,324,659 B1 11/2001 Pierro
6,356,299 B1 * 3/2002 Trosino ..... B61L 23/044 348/128
6,401,015 B1 6/2002 Stewart et al.
6,435,624 B1 8/2002 Kull et al.
6,445,150 B1 9/2002 Tanner et al.
6,487,478 B1 11/2002 Azzaro et al.
6,574,748 B1 6/2003 Andress et al.
6,691,957 B2 2/2004 Hess, Jr. et al.
6,763,292 B1 7/2004 Smith et al.
6,781,524 B1 8/2004 Clark et al.
7,021,588 B2 4/2006 Hess, Jr. et al.
7,062,381 B1 6/2006 Rekow et al.
7,164,368 B1 1/2007 Ireland
7,264,208 B2 9/2007 Kovach et al.
7,285,926 B2 10/2007 McGarry et al.
7,426,657 B2 9/2008 Zorek, Sr. et al.
7,618,011 B2 11/2009 Oleski et al.
7,653,465 B1 1/2010 Geiger et al.
7,659,972 B2 * 2/2010 Magnus ..... B61K 9/08 356/237.1
7,711,983 B2 5/2010 Hatasaki et al.
7,715,956 B2 5/2010 Bryant
7,725,252 B2 5/2010 Heddebaut et al.
7,755,660 B2 * 7/2010 Nejikovsky ..... B61K 9/08 348/135
7,801,333 B2 * 9/2010 Laurent ..... G01C 7/04 382/104
8,073,591 B2 12/2011 Bartling
8,264,330 B2 9/2012 Yeldell et al.
8,306,670 B2 11/2012 Oda
8,345,948 B2 * 1/2013 Zarembski ..... B61K 9/08 382/141
8,364,338 B2 1/2013 Peltonen et al.
8,386,830 B2 2/2013 Tameshige et al.
2001/0029411 A1 10/2001 Hawthorne
2001/0044681 A1 11/2001 Diana et al.
2002/0087578 A1 7/2002 Vroman
2002/0183901 A1 12/2002 Wolf et al.
2003/0009274 A1 1/2003 Peterson, Jr. et al.
2003/0214417 A1 11/2003 Peltz et al.
2003/0223387 A1 12/2003 Davenport et al.
2004/0100938 A1 5/2004 Aiken et al.
2004/0117073 A1 6/2004 Horst
2005/0024001 A1 2/2005 Donnelly et al.
2005/0060068 A1 3/2005 Ruckser
2005/0099061 A1 5/2005 Hollandsworth et al.
2005/0125112 A1 6/2005 LaDuc et al.
2005/0125113 A1 6/2005 Wheeler et al.
2006/0025903 A1 2/2006 Kumar
2006/0180709 A1 8/2006 Breton et al.
2006/0274930 A1 * 12/2006 Laurent ..... G01C 7/04 382/141
2007/0093946 A1 4/2007 Gideoni
2007/0179681 A1 8/2007 Shaffer et al.
2007/0219680 A1 9/2007 Kumar et al.
2008/0173770 A1 7/2008 Ruggiero et al.
2008/0246338 A1 10/2008 Donnelly et al.
2008/0306640 A1 12/2008 Rosenthal et al.
2009/0037038 A1 2/2009 Mollet et al.
2009/0132179 A1 * 5/2009 Fu ..... G01M 99/007 702/34
2009/0248226 A1 10/2009 Kellner et al.
2009/0326746 A1 12/2009 Mian
2010/0049384 A1 2/2010 Kraeling et al.
2010/0063673 A1 3/2010 Anderson
2010/0091663 A1 4/2010 Takeyama et al.
2010/0145557 A1 6/2010 Katzer
2010/0217462 A1 8/2010 Shaffer et al.
2010/0241295 A1 9/2010 Cooper et al.
2010/0286853 A1 11/2010 Goodermuth et al.
2011/0027378 A1 2/2011 Pendharkar et al.
2011/0183605 A1 7/2011 Smith, Jr. et al.
2011/0185010 A1 7/2011 Shatsky et al.
2011/0284700 A1 11/2011 Brand et al.
2012/0078452 A1 3/2012 Daum et al.
2012/0078453 A1 3/2012 Daum et al.

FOREIGN PATENT DOCUMENTS

CN 101184059 A 5/2008
DE 102005001404 A1 7/2006
DE 202010006811 U1 7/2010
EP 0499199 A2 8/1992
EP 1719688 A1 11/2006
EP 1886893 A1 2/2008
EP 2487803 A1 8/2012
KR 20110039071 A 4/2011
KZ 386 U 8/2008
RU 2025310 C1 12/1994
RU 2238860 C1 10/2004
WO 0071399 A1 11/2000
WO 2004077378 A1 9/2004
WO 2006062056 A1 6/2006
WO 2007095401 A2 8/2007
WO 2007095402 A2 8/2007
WO 2011042943 A1 4/2011

(56) References Cited

FOREIGN PATENT DOCUMENTS

| | | |
|---|---|---|
| WO | 2012021225 A2 | 2/2012 |
| WO | 2014026086 A2 | 2/2014 |

OTHER PUBLICATIONS

Agenjos et at, "Energy Efficiency in Railways: Energy Storage and Electric Generation in Diesel Electric Locomotives", 20th International Conference on Electricity Distribution, Prague, pp. 1-7, 8-11 Jun. 2009.
Chang et al., "Forward Error Correction for 100 G Transport Networks", IEEE Communications Magazine, pp. 1-8, Mar. 2010.
PCT Search Report and Written Opinion issued in connection with related PCT Application No. PCT/US2010/053471 on Jan. 21, 2011.
PCT Search Report and Written Opinion issued in connection with related PCT Application No. PCT/US2012/043579 on Nov. 26, 2012.
AU Examination Report issued in connection with related AU Application No. 2010310710 on Mar. 20, 2013.
US Non-Final OA issued in connection with related U.S. Appl. No. 12/908,214 on Apr. 22, 2013.
US Non-Final OA issued in connection with related U.S. Appl. No. 13/183,626 on May 7, 2013.
PCT Search Report and Written Opinion issued in connection with related PCT Application No. PCT/US2012/068852 on Jun. 3, 2013.
US Non-Final OA issued in connection with related U.S. Appl. No. 13/339,008 on Jun. 20, 2013.
US Final OA issued in connection with related U.S. Appl. No. 12/908,214 on Sep. 19, 2013.
US Notice of Allowance issued in connection with related U.S. Appl. No. 12/908,214 on Oct. 2, 2013.
US Non-Final OA issued in connection with related U.S. Appl. No. 14/152,517 on Mar. 11, 2014.
Unofficial English Translation of Chinese Office Action issued in connection with related CN Application No. 201080059233.9 on Apr. 3, 2014.
Knight, "10-4, Good Computer: Automated System Lets Trucks Convoy as One; A Recent Demonstration Involving Two Trucks Tethered by Computer Control Shows How Automation and Vehicle-To-Vehicle Communication are creeping onto the Roads", MIT Technology Review, 28 May 2014, http://www.technologyreview.com/news/527476/10-4-good-computer-automated-system-lets-trucks-convoy-as-one/ retrieved on Feb. 22, 2016.
US Notice of Allowance issued in connection with related U.S. Appl. No. 14/152,517 on Aug. 1, 2014.
US Non-Final OA issued in connection with related U.S. Appl. No. 13/960,053 on Aug. 12, 2014.
EA Office Action issued in connection with related EA Application No. 201290166 on Sep. 23, 2014.
US Final OA issued in connection with related U.S. Appl. No. 13/960,053 on Jan. 6, 2015.
KZ Office Action issued in connection with related KZ Application No. 2014/1501.1 on Mar. 5, 2015.
EA Office Action issued in connection with related EA Application No. 201290166 on Mar. 21, 2015.
AU Examination Report issued in connection with related AU Application No. 2012362895 on May 26, 2015.
Chinese Office Action issued in connection with related CN Application No. 2013800266526.6 on Jul. 24, 2015.
KZ Office Action issued in connection with related KZ Application No. 2014/1623.1 on Oct. 29, 2015.
AU Examination Report issued in connection with related AU Application No. 2014277814 on Nov. 27, 2015.
US Non-Final OA issued in connection with related U.S. Appl. No. 14/679,462 on Dec. 4, 2015.
US Non-Final Oa issued in connection with related U.S. Appl. No. 14/525,326 on Feb. 23, 2016.
KZ Notice of Allowance issued in connection with related KZ Application No. 201411501.1 on Feb. 26, 2016.
U.S. Appl. No. 12/908,214, filed Oct. 20, 2010 Jared Klineman Cooper et al.
US Non-Final OA issued in connection with related U.S. Appl. No. 11/183,369 on Oct. 14, 2008.
US Final OA issued in connection with related U.S. Appl. No. 11/183,369 on Oct. 15, 2009.
US Non-Final OA issued in connection with related U.S. Appl. No. 11/183,369 on Jun. 25, 2012.
US Final OA issued in connection with related U.S. Appl. No. 11/183,369 on Jan. 22, 2013.
US Non-Final OA issued in connection with related U.S. Appl. No. 13/900,307 on Feb. 3, 2016.
U.S. Appl. No. 13/478,388, filed May 23, 2012, Jared Klineman Cooper et al.
U.S. Appl. No. 14/525,326, filed Oct. 28, 2014, Jared Klineman Cooper et al.
U.S. Appl. No. 13/339,008, filed Dec. 28, 2011, Jared K. Cooper et al.
U.S. Appl. No. 12/908,214, filed Oct. 20, 2010, Jared Klineman Cooper et al.
U.S. Appl. No. 14/679,462, filed Apr. 6, 2015, Mark Bradshaw Kraeling et al.
U.S. Appl. No. 13/900,307, filed May 22, 2013, Jared Klineman Cooper et al.

* cited by examiner

SYSTEM AND METHOD FOR INSPECTING A ROUTE DURING MOVEMENT OF A VEHICLE SYSTEM OVER THE ROUTE

CROSS-REFERENCE TO RELATED APPLICATIONS

This application is a continuation of U.S. patent application Ser. No. 14/152,159, filed 10 Jan. 2014, which is a continuation-in-part of U.S. patent application Ser. No. 13/478,388, which was filed on 23 May 2012 and is now abandoned (the "'388 application"). The entire disclosure of the '388 application is incorporated by reference.

FIELD

The inventive subject matter described herein relates to inspection systems.

BACKGROUND

Known inspection systems are used to examine routes traveled by vehicles for damage. For example, a variety of handheld, trackside, and vehicle mounted systems are used to examine railroad tracks for damage, such as cracks, pitting, or breaks. These systems are used to identify damage to the tracks prior to the damage becoming severe enough to cause accidents by vehicles on the tracks. Once the systems identify the damage, maintenance can be scheduled to repair or replace the damaged portion of the tracks.

Some known handheld inspection systems are carried by a human operator as the operator walks alongside the route. Such systems are relatively slow and are not useful for inspecting the route over relatively long distances. Some known trackside inspection systems use electronic currents transmitted through the rails of a track to inspect for broken rails. But, these systems are fixed in location and may be unable to inspect for a variety of other types of damage to the track other than broken rails.

Some known vehicle mounted inspection systems use sensors coupled to a vehicle that travels along the route. The sensors obtain ultrasound or optic data related to the route. The data is later inspected to determine damage to the route. But, some of these systems involve specially designed vehicles in order to obtain the data from the route. These vehicles are dedicated to inspecting the route and are not used for transferring large amounts of cargo or passengers long distances. Consequently, these types of vehicles add to the cost and maintenance of a fleet of vehicles without contributing to the capacity of the fleet to convey cargo or passengers.

Others of these types of vehicle mounted systems may be limited by using only a single type of sensor. Still others of these vehicle mounted inspection systems are limited in the types of sensors that can be used due to the relatively fast travel of the vehicles. For example, some sensors may require relatively slow traveling vehicles, which may be appropriate for specially designed vehicles but not for other vehicles, such as cargo or passenger trains having the sensors mounted thereto. The specially designed vehicles can be relatively expensive and add to the cost and maintenance of a fleet of vehicles.

BRIEF DESCRIPTION

In one example of the inventive subject matter described herein, a sensing system includes a leading sensor, a trailing sensor, and a route examining unit. The leading sensor is configured to be coupled to a leading rail vehicle of a rail vehicle system that travels along a track. The leading sensor also is configured to acquire first inspection data indicative of a condition of the track in an examined section of the track as the rail vehicle system travels over the track. The trailing sensor is configured to be coupled to a trailing rail vehicle of the rail vehicle system and to acquire additional, second inspection data indicative of the condition of the track subsequent to the leading rail vehicle passing over the examined section of the track and the leading sensor acquiring the first inspection data. The route examining unit is configured to be disposed onboard the rail vehicle system. The route examining unit also is configured to direct the trailing sensor to acquire the second inspection data in the examined section of the track when the first inspection data indicates damage to the track such that both the leading sensor and the trailing sensor acquire the first inspection data and the second inspection data, respectively, of the examined section of the track during a single pass of the rail vehicle system over the examined section of the track. The leading sensor can be configured to acquire the first inspection data at a first resolution level and the trailing sensor can be configured to acquire the second inspection data at a second resolution level that is greater than the first resolution level such that the second inspection data includes a greater amount of data than the first inspection data at least one of per unit time, per unit distance, or per unit area.

In another example of the inventive subject matter described herein, a sensing system includes a leading sensor, a trailing sensor, and a route examining unit. The leading sensor is configured to be coupled to a leading rail vehicle of a rail vehicle system that travels along a track. The leading sensor also is configured to automatically acquire first inspection data indicative of a condition of the track in an examined section of the track as the rail vehicle system travels over the track. The first inspection data can be acquired at a first resolution level. The trailing sensor is configured to be coupled to a trailing rail vehicle of the rail vehicle system and to automatically acquire additional, second inspection data indicative of the condition of the track subsequent to the leading rail vehicle passing over the examined section of the track and the leading sensor acquiring the first inspection data. The second inspection data can be acquired at a second resolution level that is greater than the first resolution level such that the second inspection data includes a greater amount of data than the first inspection data at least one of per unit time, per unit distance, or per unit area. The leading rail vehicle and the trailing rail vehicle can be directly or indirectly mechanically connected in the rail vehicle system. The route examining unit is configured to be disposed onboard the rail vehicle system. The route examining unit also can be configured to automatically direct the trailing sensor to acquire the second inspection data in the examined section of the track when the first inspection data indicates damage to the track such that both the leading sensor and the trailing sensor acquire the first inspection data and the second inspection data, respectively, of the examined section of the track during a single pass of the rail vehicle system over the examined section of the track.

In another example of the inventive subject matter described herein, a sensing system includes a leading sensor, a trailing sensor, and a route examining unit. The leading sensor is configured to be disposed onboard a first vehicle of a vehicle system that travels along a route. The leading sensor also is configured to measure first characteristics of the route as the vehicle system travels along the route. The trailing sensor is configured to be disposed onboard a second vehicle of the vehicle system that is directly or indirectly mechanically coupled with the first vehicle. The trailing sensor also is configured to measure second characteristics of the route as the vehicle system moves along the route. The route examining unit is configured to be disposed onboard the vehicle system. The route examining unit is configured to receive the first characteristics of the route and the second characteristics of the route and to compare the first characteristics with the second characteristics, the route examining unit also configured to identify a segment of the route as being damaged based on a comparison of the first characteristics with the second characteristics.

In one embodiment, a sensing system is provided that includes a leading sensor, a trailing sensor, and a route examining unit. As used herein, the term "leading" is meant to indicate that the sensor, vehicle, or other component travels over a location along the route ahead of (e.g., before) another sensor, vehicle, or other component (e.g., a "trailing" sensor, vehicle, or component) for a direction of travel. For example, in a first direction of travel, a first vehicle or sensor may be the leading vehicle or sensor when the first vehicle or sensor travels over a designated location before a second vehicle or sensor. The second vehicle or sensor may be the trailing vehicle. But, for an opposite, second direction of travel, the second vehicle or sensor may travel over the designated location before the first vehicle or sensor and, as a result, the second vehicle or sensor is the leading vehicle or sensor while the first vehicle or sensor is the trailing vehicle or sensor.

The leading sensor is configured to be coupled to a vehicle system that travels along a route. The leading sensor also is configured to acquire first inspection data indicative of a condition of the route as the vehicle system travels over the route. The condition may represent the health (e.g., damaged or not damaged, a degree of damage, and the like) of the route. The trailing sensor is configured to be coupled to the vehicle system and to acquire additional, second inspection data that is indicative of the condition to the route subsequent to the leading sensor acquiring the first inspection data. The route examining unit is configured to be disposed onboard the vehicle system and to identify a section of interest in the route based on the first inspection data acquired by the leading sensor. The route examining unit also is configured to direct the trailing sensor to acquire the second inspection data within the section of interest in the route when the first inspection data indicates damage to the route in the section of interest.

In another embodiment, a method (e.g., for acquiring inspection data of a route) includes acquiring first inspection data indicative of a condition of a route from a leading sensor coupled to a leading vehicle in a vehicle system as the vehicle system travels over the route, determining that the first inspection data indicates damage to the route in a section of interest in the route, and directing a trailing sensor coupled to a trailing vehicle of the vehicle system to acquire additional, second inspection data of the route when the first inspection data indicates the damage to the route. The leading vehicle and the trailing vehicle are mechanically directly or indirectly interconnected with each other in the vehicle system such that the leading vehicle passes over the section of interest of the route before the trailing vehicle.

In another embodiment, a sensing system includes a leading sensor, a trailing sensor, and a route examining unit. The leading sensor is configured to be coupled to a leading rail vehicle of a rail vehicle system that travels along a track. The leading sensor also is configured to acquire first inspection data indicative of a condition of the track in an examined section of the track as the rail vehicle system travels over the track. The trailing sensor is configured to be coupled to a trailing rail vehicle of the rail vehicle system and to acquire additional, second inspection data indicative of the condition to the track subsequent to the leading rail vehicle passing over the examined section of the track and the leading sensor acquiring the first inspection data. The route examining unit is configured to be disposed onboard the rail vehicle system. The route examining unit also is configured to direct the trailing sensor to acquire the second inspection data in the examined section of the track when the first inspection data indicates damage to the track such that both the leading sensor and the trailing sensor acquire the first inspection data and the second inspection data, respectively, of the examined section of the track during a single pass of the rail vehicle system over the examined section of the track.

In one aspect, a sensing system comprises a leading sensor configured to be coupled to a leading rail vehicle of a rail vehicle system that travels along a track. The leading sensor is also configured to automatically acquire first inspection data indicative of a condition of the track in an examined section of the track as the rail vehicle system travels over the track. The first inspection data is acquired at a first resolution level. The sensing system further comprises a trailing sensor configured to be coupled to a trailing rail vehicle of the rail vehicle system and to automatically acquire additional, second inspection data indicative of the condition of the track subsequent to the leading rail vehicle passing over the examined section of the track and the leading sensor acquiring the first inspection data. The second inspection data is acquired at a second resolution level that is greater than the first resolution level. The leading rail vehicle and the trailing rail vehicle are directly or indirectly mechanically connected in the rail vehicle system. The sensing system further includes a route examining unit configured to be disposed onboard the rail vehicle system. The route examining unit is also configured to automatically direct the trailing sensor to acquire the second inspection data in the examined section of the track when the first inspection data indicates damage to the track, such that both the leading sensor and the trailing sensor acquire the first inspection data and the second inspection data, respectively, of the examined section of the track during a single pass of the rail vehicle system over the examined section of the track. In one aspect, the rail vehicle system may be a train, and the leading rail vehicle and the trailing rail vehicle may be first and second locomotives of the train.

In another embodiment, a sensing system includes a route examining unit that is configured to be disposed onboard a vehicle system that travels along a route. The route examining unit also is configured to receive first inspection data from a leading sensor configured to be coupled to a leading vehicle of the vehicle system as the vehicle system travels over the route. The first inspection data is indicative of a condition of the route in an examined section of the route. The route examining unit is further configured to identify damage in the examined section of the route based on the first inspection data and to direct a trailing sensor to acquire second inspection data in the examined section of the route responsive to identifying the damage. The trailing sensor is configured to be coupled to a trailing vehicle of the vehicle system that is indirectly or directly mechanically coupled to the leading vehicle.

BRIEF DESCRIPTION OF THE DRAWINGS

Reference is now made briefly to the accompanying drawings, in which.

DETAILED DESCRIPTION

Figure 1:
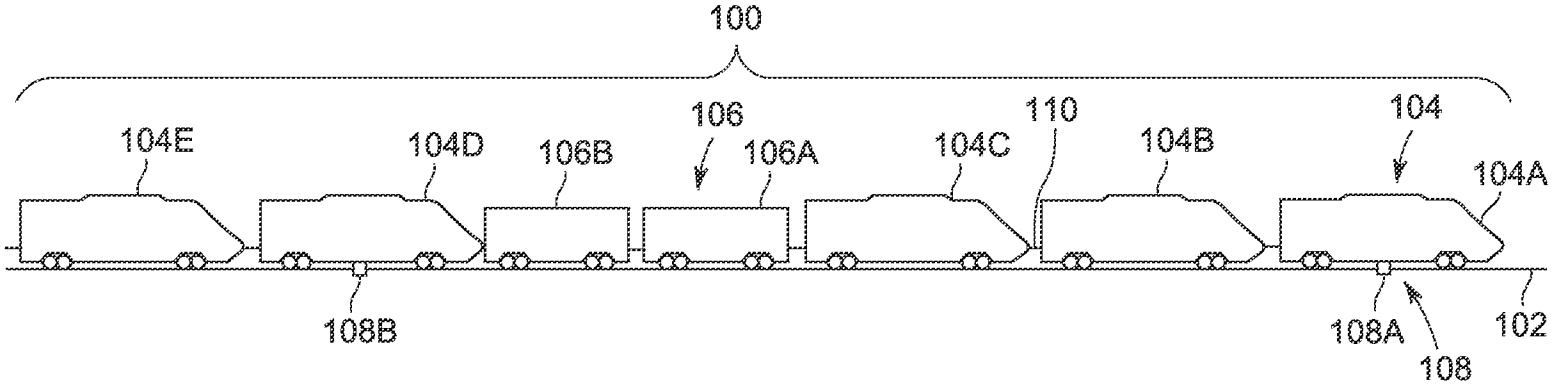
FIG. 1 is a schematic diagram of a vehicle system traveling along a route in accordance with one embodiment of the inventive subject matter.

FIG. 1 is a schematic diagram of a vehicle system 100 traveling along a route 102 in accordance with one embodiment of the inventive subject matter. The vehicle system 100 includes several powered vehicles 104 (e.g., powered vehicles 104A-E) and several non-powered vehicles 106 (e.g., non-powered vehicles 106A-B) mechanically interconnected with each other such that the vehicles 104, 106 travel together as a unit. The vehicles 104, 106 may be connected with each other by coupler devices 110. The terms "powered" and "non-powered" indicate the capability of the different vehicles 104, 106 to self-propel. For example, the powered vehicles 104 represent vehicles that are capable of self-propulsion (e.g., that include motors that generate tractive effort). The non-powered vehicles 106 represent vehicles that are incapable of self-propulsion (e.g., do not include motors that generate tractive effort), but may otherwise receive or use electric current for one or more purposes other than propulsion. In the illustrated embodiment, the powered vehicles 104 are locomotives and the non-powered vehicles 106 are non-locomotive rail cars linked together in a train. (Examples of non-powered rail vehicles include box cars, tanker cars, flatbed cars, and other cargo cars, and certain types of passenger cars.) Alternatively, the vehicle system 100, powered vehicles 104, and/or non-powered vehicles 106 may represent another type of rail vehicle, another type of off-highway vehicle, automobiles, and the like. The route 102 may represent a track, road, and the like.

In one embodiment, the vehicle system 100 operates in a distributed power (DP) arrangement, where at least one powered unit 104 is designated as a lead unit that controls or dictates operational settings (e.g., brake settings and/or throttle settings) of other powered units (e.g., trailing powered units 104) in the vehicle system 100. The powered units 104 may communicate with each other to coordinate the operational settings according to the commands of the leading powered unit 104 through one or more communication links, such as a wireless radio communication link, an electronically controlled pneumatic (ECP) brake line, multiple unit (MU) cable, and the like.

The vehicle system 100 includes plural sensors 108 (e.g., sensors 108A, 108B) that monitor the route 102 for damage as the vehicle system 100 moves along the route 102. While only two sensors 108 are shown in the illustrated embodiment, the vehicle system 100 may include additional sensors 108. Additionally, while the sensors 108 are shown coupled with the powered vehicles 104, one or more of the sensors 108 may be coupled with a non-powered vehicle 106. The sensors 108 can examine the route 102 for damage such as broken sections of a rail, pitted sections of a road or rail, cracks on an exterior surface or interior of a rail or road, and the like. The sensors 108 may be the same or different types of sensors that examine the route 102. By "types," it is meant that the sensors 108 may use different technologies or techniques to examine the route 102, such as ultrasound, electric current, magnetic fields, optics, acoustics, distance measurement, force displacement, and the like, representing some different technologies or techniques.

For example, with respect to ultrasound, one or more of the sensors 108 may include an ultrasound transducer that emits ultrasound pulses into the route 102 and monitors echoes of the pulses to identify potential damage to the route 102. With respect to electric current, one or more of the sensors 108 may include probes that measure the transmission of electric current through the route 102, such as by using a section of the route 102 to close a circuit, to identify damage to the route 102. An opening of the circuit can be indicative of a broken portion of the route 102, such as a broken rail. With respect to magnetic fields, one or more the sensors 108 may measure eddy currents in the route 102 when the route 102 is exposed to a magnetic field. With respect to optics, the sensors 108 may acquire video and/or static images of the route 102 to identify damage to the route 102. Alternatively or additionally, the sensors 108 may use optics, such as laser light, to measure a profile, positions, or displacement of the route 102 (e.g., displacement of rails of a track). With respect to acoustics, the sensors 108 may monitor sounds, such as sounds created when the vehicle system 100 travels over the route 102, to identify damage to the route 102. With respect to distance measurement, the sensors 108 may include probes that engage the route 102 to measure distances to or between portions of the route 102 to identify damage. With respect to force displacement, the sensors 108 may include probes that engage and attempt to push sections of the route 102 to identify damage and/or strength of the route 102.

The sensors 108 that are in the vehicle system 100 may be the same or different types of sensors 108. Additionally or alternatively, one or more of the sensors 108 may represent a sensor array that includes two or more of the same or different types of sensors 108. The sensors 108 acquire data (e.g., ultrasound data, electric circuit data, eddy current data, magnetic data, optic data, displacement data, force data, acoustic data, and the like) that represents a condition of the route 102. This data is referred to as inspection data.

One of the sensors 108A is positioned ahead of another one of the sensors 108B along a direction of travel of the vehicle system 100. The sensor 108A that is positioned ahead of the sensor 108B is referred to as a leading sensor while the sensor 108B that is positioned behind or downstream from the leading sensor 108A along the direction of travel of the vehicle system 100 is referred to as a trailing sensor 108B. The vehicle 104, 106 to which the leading sensor 108A is coupled can be referred to as the leading vehicle (e.g., the leading powered vehicle 104A) and the vehicle 104, 106 to which the trailing sensor 108B is coupled is referred to as the trailing vehicle (e.g., the trailing powered vehicle 104D).

As the vehicle system 100 moves along the route 102, the sensors 108 acquire inspection data of the route 102 to monitor the condition of the route 102. The sensors 108 obtain inspection data that is examined (e.g., by a route examination unit) to identify potential sections of interest in the route 102 that may include damage to the route 102, such as breaks in a rail, cracks in the route 102, pitting in the route 102, and the like.

Figure 2:
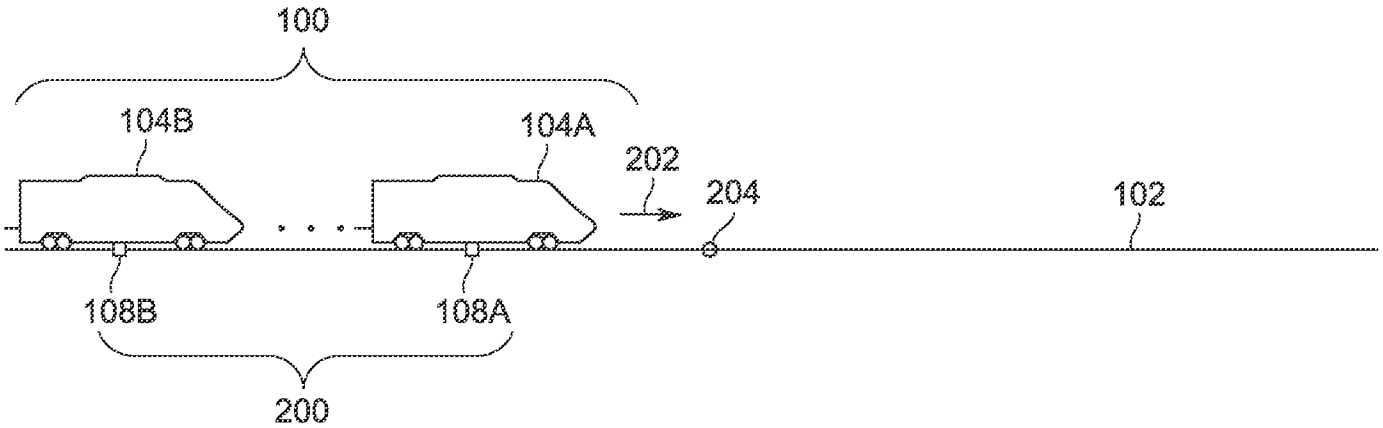
FIG. 2 illustrates one example of the vehicle system shown in FIG. 1 approaching a damaged portion of the route shown in FIG. 1.
Figure 3:
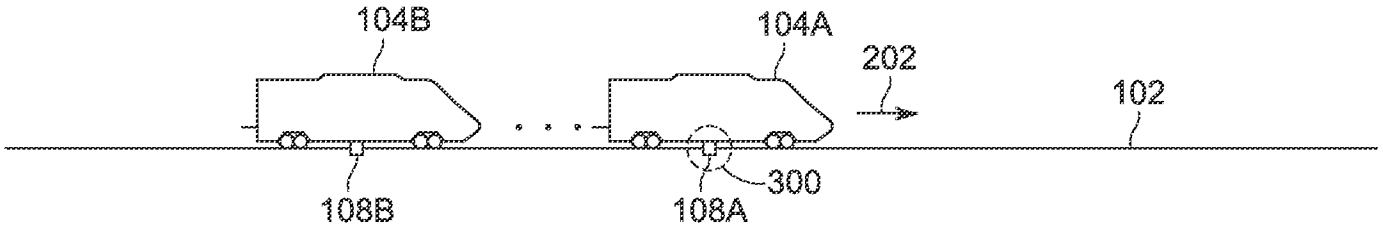
FIG. 3 illustrates one example of a leading sensor shown in FIG. 1 of a sensing system shown in FIG. 2 passing over the damaged portion of the route as shown in FIG. 2.
Figure 4:
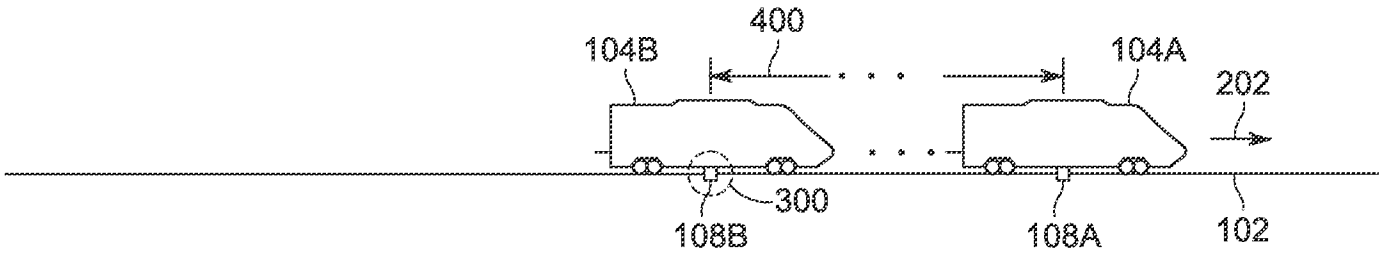
FIG. 4 illustrates a trailing sensor of the sensing system shown in FIG. 2 subsequently passing over the damaged portion of the route as shown in FIG. 2.

FIGS. 2 through 4 illustrate one example of operation of a sensing system 200 of the vehicle system 100. The sensing system 200 includes the sensors 108 of the vehicle system 100. Only the leading and trailing vehicles 104A, 104B of the vehicle system 100 are shown in FIG. 1, but, as described above, one or more powered and/or non-powered vehicles 104, 106 may be disposed between and interconnected with the leading and trailing vehicles 104A, 104B. FIG. 2 shows the vehicle system 100 approaching a damaged portion 204 of the route 102, FIG. 3 shows the leading sensor 108A of the sensing system 200 passing over the damaged portion 204 of the route 102, and FIG. 4 shows the trailing sensor 108B of the sensing system 200 subsequently passing over the damaged portion 204 of the route 102. The damaged portions 204 of the route 102, such as sections of the route 102 that include cracks, breaks, pitting, and the like.

In operation, the vehicle system 100 moves along the route 102 in a direction of travel 202. The leading sensor 108A may acquire inspection data of the route 102 as the vehicle system 100 moves along the route 102. The leading sensor 108A can acquire the inspection data on a periodic or continual basis, when automatically prompted by a control unit (described below) of the vehicle system 100, and/or when manually prompted by an operator of the vehicle system 100 using an input device (described below).

When the leading sensor 108A passes over the damaged portion 204 of the route 102 (as shown in FIG. 3), the leading sensor 108A may acquire inspection data representative of the damage to the route 102 in the damaged portion 204. This inspection data can be examined by the route examining unit (described below) of the vehicle system 100 to identify potential damage to the route 102. The sensing system 200 can designate the section of the route 102 that includes the identified potential damage as a section of interest 300 in the route 102. The section of interest 300 may be identified as including portions of the route 102 in addition to the location where the potential damage is identified. For example, the sensing system 200 can designate the section of interest 300 as including an additional margin (e.g., section) of the route 102 ahead of and/or behind (e.g., along the direction of travel 202) the location where the potential damage is identified. Designating the section of interest 300 as including more of the route 102 than just the exact location of where the potential damage is identified can increase the probability that the trailing sensor 108B can acquire inspection data of the entire damage to the route 102 in or near the damaged portion 204.

Alternatively, the section of interest 300 may represent an examined section of the route 102, or a section of the route 102 that is being examined for damage relative to other sections of the route 102. For example, the leading sensor 108A may be activated to acquire inspection data only for designated or selected (e.g., autonomously or manually selected) portions of the route 102. The section of interest 300 may represent at least one of the designated or selected portions that are associated with potential damage to the route 102, as determined from the inspection data acquired by the leading sensor 108A.

In response to identifying the section of interest 300, the sensing system 200 may direct the trailing sensor 108B to acquire additional inspection data of the route 102 in the section of interest 300. In one embodiment, the trailing sensor 108B is inactive (e.g., such as by being deactivated, turned OFF, or otherwise not obtaining inspection data of the route 102) until activated by the sensing system 200 in response to the section of interest 300 being identified from inspection data acquired by the leading sensor 108A. The sensing system 200 can determine when the trailing sensor 108B will pass over the section of interest 300 (as shown in FIG. 4) based on one or more characteristics of the vehicle system 100.

For example, the sensing system 200 can determine when the trailing sensor 108B will pass over the section of interest 300 based on the velocity of the vehicle system 100 along the direction of travel 202 and a separation distance 400 between the leading and trailing sensors 108A, 108B along the vehicle system 100. In an embodiment where the vehicle system 100 includes several vehicles 104, 106 following a curved route 102 and/or undulating route 102 (e.g., that passes over one or more hills, mounds, dips, and the like), the separation distance 400 can be measured along the length of the vehicle system 100 as the vehicle system 100 curves and/or undulates along the route 102. The sensing system 200 can determine when the trailing sensor 108B will pass over the section of interest 300 based on the separation distance 400 and the velocity of the vehicle system 100 and then direct the trailing sensor 108B to acquire the additional inspection data of the section of interest 300 when (or just prior to) the trailing sensor 108B passing over the section of interest 300.

Alternatively, the trailing sensor 108B may be actively acquiring additional inspection data of the route 102 when the sensing system 200 identifies the section of interest 300 based on the inspection data from the leading sensor 108A. The sensing system 200 may then flag or otherwise designate the inspection data acquired by the trailing sensor 108B when the trailing sensor 108B passes over the section of interest 300 as being inspection data of interest (e.g., data obtained from the section of interest 300).

In response to identifying the section of interest 300, the sensing system 200 may direct the trailing sensor 108B to acquire the additional inspection data at a greater (e.g., finer) resolution or resolution level relative to the inspection data acquired by the leading sensor 108A. For example, the trailing sensor 108B may be directed to acquire more measurements of the route 102 per unit time than the leading sensor 108A. As another example, the trailing sensor 108B may optically acquire data (e.g., via a camera) of the section of interest 300 with a much smaller lateral resolution than the optically acquired data obtained by the leading sensor 108A. The lateral resolution can refer to the distances between two distinguishable points in the image or video data that is acquired. For example, the smallest distance between two or more distinguishable points in the image acquired by the leading sensor 108A may be larger than the smallest distance between two or more distinguishable points in the image acquired by the trailing sensor 108B. The trailing sensor 108B may have a smaller limiting resolution measured using the USAF 1951 resolution test target than the leading sensor 108A. In one aspect, the difference in resolutions between the leading and trailing sensors 108A, 108B does not refer to how close the sensors 108A, 108B are to an object being imaged. That is, if the trailing and leading sensors 108A, 108B were the same or similar type of cameras, the fact that the trailing sensor 108B is disposed closer to the route 102 than the leading sensor 108A may not necessarily mean that the trailing sensor 108B acquires images or video of the route 102 at a greater resolution than the trailing sensor 108B.

Alternatively or additionally, the trailing sensor 108B may be directed to acquire measurements having greater detail (e.g., data) of the potential damage to the route 102 than the leading sensor 108A. Alternatively or additionally, the trailing sensor 108B may be directed to acquire a different type of inspection data of the route 102 than the leading sensor 108A. Alternatively or additionally, the trailing sensor 108B may be directed to acquire more measurements (e.g., more inspection data) of the potential damage to the route 102 than the leading sensor 108A.

The sensing system 200 may be in communication with a propulsion system (described below) of the vehicle system 100 to coordinate movement of the vehicle system 100 with the locations of the leading sensor 108A and/or trailing sensor 108B in response to identification of the section of interest 300 in the route 102. For example, when the section of interest 300 is identified based on the inspection data from the leading sensor 108A, the sensing system 200 may communicate with a controller (described below) of the vehicle system 100 that autonomously controls the propulsion system of the vehicle system 100 so that the velocity of the vehicle system 100 slows down when the trailing sensor 108B passes over the section of interest 300. Alternatively or additionally, the controller may generate commands that are output to an operator of the vehicle system 100 to direct the operator to manually control propulsion system of the vehicle system 100 so that the velocity of the vehicle system 100 slows down when the trailing sensor 108B passes over the section of interest 300. The vehicle system 100 can slow down just prior to the trailing sensor 108B passing over the section of interest 300, as soon as the section of interest 300 is identified, and/or when the trailing sensor 108B reaches the section of interest 300. The vehicle system 100 may slow down so that the trailing sensor 108B can acquire the additional inspection data at a higher resolution than the inspection data from the leading sensor 108A. For example, if both the leading and trailing sensors 108A, 108B acquire inspection data at the same or approximately the same rate, then slowing down the vehicle system 100 when the trailing sensor 108B acquires the inspection data can allow for more inspection data (e.g., data at a higher resolution) from the trailing sensor 108B than the inspection data from the leading sensor 108A. Even if the leading and trailing sensors 108A, 108B acquire inspection data at different rates, slowing down the vehicle system 100 can allow for the trailing sensor 108B to acquire the inspection data at a greater resolution.

As another example, when the section of interest 300 is identified based on the inspection data from the leading sensor 108A, the sensing system 200 may communicate with the propulsion system of the vehicle system 100 in order to change a slack in one or more coupler devices 110 between the connected vehicles 104, 106. For example, the propulsion system may change movement of the vehicle system 100 so that forces exerted on one or more of the coupler devices 110 are modified. The slack may be modified by reducing the slack (e.g., increasing the tensile forces on the coupler device 110) between the trailing vehicle 104B and one or more of the vehicles 104, 106 coupled with the trailing vehicle 104B. Reducing the slack can allow for reduced movement of the trailing vehicle 104B and the trailing sensor 108B relative to the other vehicles 104, 106 in the vehicle system 100. Such reduced movement also can reduce noise in the inspection data and/or erroneous inspection data acquired by the trailing sensor 108B.

The operation of the vehicle system 100 described above allows for the sensing system 200 to acquire inspection data of one or more sections of interest 300 in the route 102 by two or more sensors 108A, 108B at two or more different locations in the vehicle system 100 during a single pass of the vehicle system 100 over the section of interest 300. The multiple inspections may be performed to acquire different types of inspection data, different amounts of inspection data, inspection data at different resolutions, and the like, during a single pass of the vehicle system 100 over the section of interest 300.

Figure 5:
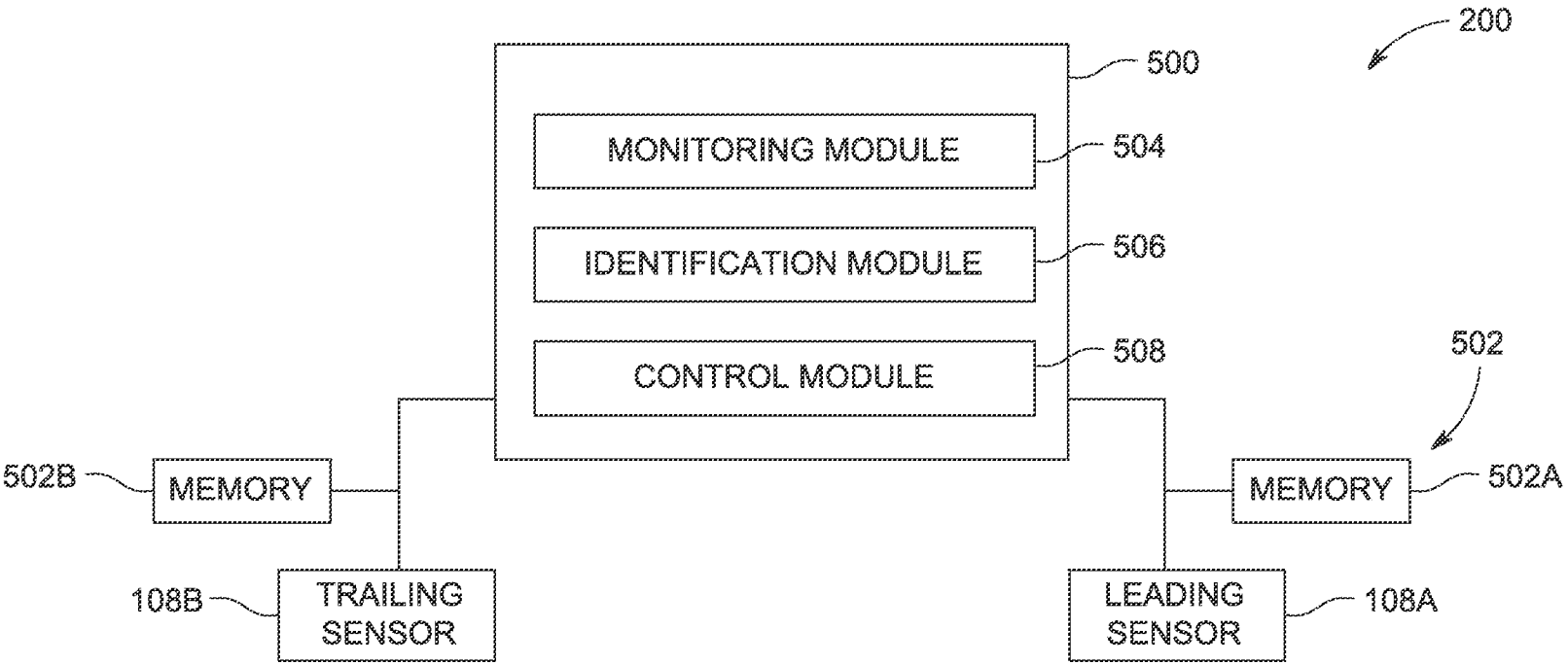
FIG. 5 is a schematic diagram of one embodiment of the sensing system shown in FIG. 2.

FIG. 5 is a schematic diagram of one embodiment of the sensing system 200. The sensing system 200 may be distributed among multiple vehicles 104, 106 (shown in FIG. 1) of the vehicle system 100 (shown in FIG. 1). For example, a route examining unit 500 of the sensing system 200 may be disposed on the same or different vehicle 104, 106 as the leading sensor 108A and/or the trailing sensor 108B. As used herein, the terms "unit" or "module" (such as the route examining unit 500, communication unit, and the like) include a hardware and/or software system that operates to perform one or more functions. For example, a unit or module may include one or more computer processors, controllers, and/or other logic-based devices that perform operations based on instructions stored on a tangible and non-transitory computer readable storage medium, such as a computer memory. Alternatively, a unit or module may include a hard-wired device that performs operations based on hard-wired logic of a processor, controller, or other device. In one or more embodiments, a unit or module includes or is associated with a tangible and non-transitory (e.g., not an electric signal) computer readable medium, such as a computer memory. The units or modules shown in the attached figures may represent the hardware that operates based on software or hardwired instructions, the computer readable medium used to store and/or provide the instructions, the software that directs hardware to perform the operations, or a combination thereof.

The route examining unit 500 is communicatively coupled (e.g., by one or more wired and/or wireless communication links 502) with the leading sensor 108A and the trailing sensor 108B. The communication links 502 can represent wireless radio communications between powered units 104 in a DP arrangement or configuration, as described above, communications over an ECP line, and the like. The route examining unit 500 is communicatively coupled with the sensors 108A, 108B to receive inspection data from the sensors 108A, 108B and to direct operations of the sensors 108A, 108B. For example, in response to receiving and examining the inspection data from the leading sensor 108A, the route examining unit 500 may direct the trailing sensor 108B to acquire additional inspection data, as described above. In one embodiment, the inspection data obtained by one or more of the sensors 108A, 108B may be stored in a tangible and non-transitory computer readable storage medium, such as a computer memory 502 (e.g., memories 502A, 502B). The memories 502A, 502B may be localized memories that are disposed at or near (e.g., on the same vehicle 104, 106) as the sensors 108A, 108B that store the inspection data on the respective memory 502A, 502B.

The route examining unit 500 includes several modules that perform one or more functions of the route examining unit 500 described herein. The modules may include or represent hardware circuits or circuitry that include and/or are coupled with one or more processors, controllers, or other electronic logic-based devices. The modules include a monitoring module 504 that monitors operations of the sensors 108A, 108B. The monitoring module 504 may track which sensors 108A, 108B are acquiring inspection data (e.g., which sensors 108 are active at one or more points in time) and/or monitor the health or condition of the sensors 108 (e.g., whether any sensors 108 are malfunctioning, such as by providing inspection data having noise above a designated threshold or a signal-to-noise ratio below a designated threshold). The monitoring module 504 may monitor operations of the vehicle system 100, such as the velocity of the vehicle system 100 and/or forces exerted on one or more coupler devices 110 (shown in FIG. 1) in the vehicle system 100.

An identification module 506 examines the inspection data provided by the sensors 108. The identification module 506 may receive the inspection data from the leading sensor 108A and determine if the inspection data is indicative or representative of potential damage to the route 102. For example, with respect to ultrasound data that is acquired as the inspection data, the identification module 506 may examine the ultrasound echoes off the route 102 to determine if the echoes represent potential damage to the route 102. Additionally or alternatively, the identification module 506 may form images from the ultrasound echoes and communicate the images to an output device (described below) so that an operator of the vehicle system 100 can manually examine the images. The operator may then manually identify the potential damage and/or confirm identification of the potential damage by the identification module 506.

The identification module 506 may examine changes in electric current transmitted through the route 102, such as by identifying openings or breaks in a circuit that is otherwise closed by the route 102. The openings or breaks can represent a broken or damaged portion of the route 102. The identification module 506 can examine the eddy currents in the route 102 when the route 102 is exposed to a magnetic field in order to determine magnetoresistive responses of the route 102 (e.g., a rail). Based on these responses, the identification module 506 can identify potential cracks, breaks, and the like, in the route 102.

The identification module 506 can examine videos or images of the route 102 to identify damage to the route 102. Alternatively or additionally, the identification module 506 may examine a profile, positions, or displacement of the route 102 to identify potential damage. The identification module 506 may form images from the videos, images, profiles, positions, or displacement and communicate the images to an output device (described below) so that an operator of the vehicle system 100 can manually examine the images. The operator may then manually identify the potential damage and/or confirm identification of the potential damage by the identification module 506.

The identification module 506 can examine the sounds (e.g., frequency, duration, and the like) measured by the sensors 108 to identify potential damage to the route 102. The identification module 506 can examine distances to or between portions of the route 102 and compare these distances to known or designated distances to identify potential damage to the route 102. The identification module 506 may examine force measurements from probes of the sensors 108 that engage and attempt to push sections of the route 102 to identify potential damage and/or mechanical strength of the route 102 (which can be indicative of potential damage to the route 102).

The identification module 506 identifies the location of the potential damage, such as by identifying where the section of interest 300 (shown in FIG. 3) is located along the route 102. The identification module 506 may communicate with a location determination system (described below) of the vehicle system 100 to determine where the section of interest 300 is located. For example, upon identifying the potential damage, the identification module 506 can obtain the current location of the vehicle system 100 (or a previous location of the vehicle system 100 that corresponds to when the inspection data indicative of the potential damage was acquired) and designate the location as the location of the section of interest 300.

The route examining unit 500 includes a control module 508 that controls operations of the sensing system 200. The control module 508 can transmit signals to the sensors 108 to direct the sensors 108 to activate and/or begin collecting inspection data of the route 102. The control module 508 may instruct the sensors 108 as to how much inspection data is to be obtained, the resolution of the inspection data to be obtained, when to begin collecting the inspection data, how long to collect the inspection data, and the like. The control module 508 can communicate with the identification module 506 to determine when potential damage to the route 102 is identified.

In one embodiment, the control module 508 automatically directs the sensors 108 to acquire inspection data. For example, responsive to the leading sensor 108A acquiring inspection data that is indicative of potential damage to the route 102, the control module 508 may autonomously (e.g., without operator intervention or action) direct the trailing sensor 108B to begin acquiring the additional inspection data, as described herein.

The control module 508 may select the resolution level at which the trailing sensor 108B is to acquire the additional inspection data from among several available resolution levels (e.g., resolution levels that the trailing sensor 108B is capable of acquiring). For example, the trailing sensor 108B may be associated with several different resolution levels that acquire the inspection data at different resolutions. When the control module 508 determines that the inspection data acquired by the leading sensor 108A indicates potential damage to the route 102, the control module 508 can select at least one of the resolution levels of the trailing sensor 108B and direct the trailing sensor 108B to acquire the additional inspection level at the selected resolution level.

In one embodiment, the control module 508 can autonomously select the resolution level (e.g., without operator input or intervention). For example, the control module 508 can select the resolution level for the trailing sensor 108B based on a current speed of the vehicle system 100, a category of the potential damage to the route 102, and/or a degree of the potential damage to the route 102. Different resolution levels can be associated with different speeds, categories of damage, and/or degrees of damage. For example, faster speeds may be associated with greater resolution levels while slower speeds are associated with lower resolution levels. As another example, a category of damage that includes damage to the interior of the route 102 (e.g., inside a rail) may be associated with greater resolution levels than a category of damage that includes damage to the exterior of the route 102. In another example, greater degrees of damage (e.g., more damage, such as a larger volume of damage, larger pits, larger cracks, larger voids, and the like) may be associated with a different resolution level than lesser degrees of damage. Once the speed, category of damage, and/or degree of damage is determined by the control module 508 (e.g., such as from a speed sensor described below and/or the identification module 506 that identifies the category and/or degree of damage), the control module 508 determines the associated resolution level, such as from information stored in an internal or external memory. The control module 508 may then automatically direct the trailing sensor 108B to acquire the additional inspection data at the selected resolution level.

Alternatively, upon identification of potential damage to the route 102 from the inspection data acquired by the leading sensor 108A, the control module 508 may direct an output device (e.g., the device 608 described below) to present the operator of the vehicle system 100 with one or more choices of resolution levels. The resolution levels that are presented to the operator may be associated with the speed of the vehicle system 100, category of damage, and/or degree of damage, as described above. The operator may then use an input device (e.g., the input device 606 described below) to select the resolution level that is to be used by the trailing sensor 108B to acquire the additional inspection data of the route 102.

The control module 508 can communicate with a control unit (described below) of the vehicle system 100 to control or modify movement of the vehicle system 100 in response to identification of potential damage to the route 102. For example, in response to the identification module 506 determining that the inspection data from the leading sensor 108A is indicative of potential damage to the route 102, the control module 508 can instruct the control unit to slow down movement of the vehicle system 100 prior to the trailing sensor 108B passing over the section of interest 300 and/or to alter movement of the vehicle system 100 in order to change the slack in the vehicle system 100, as described above.

Figure 6:
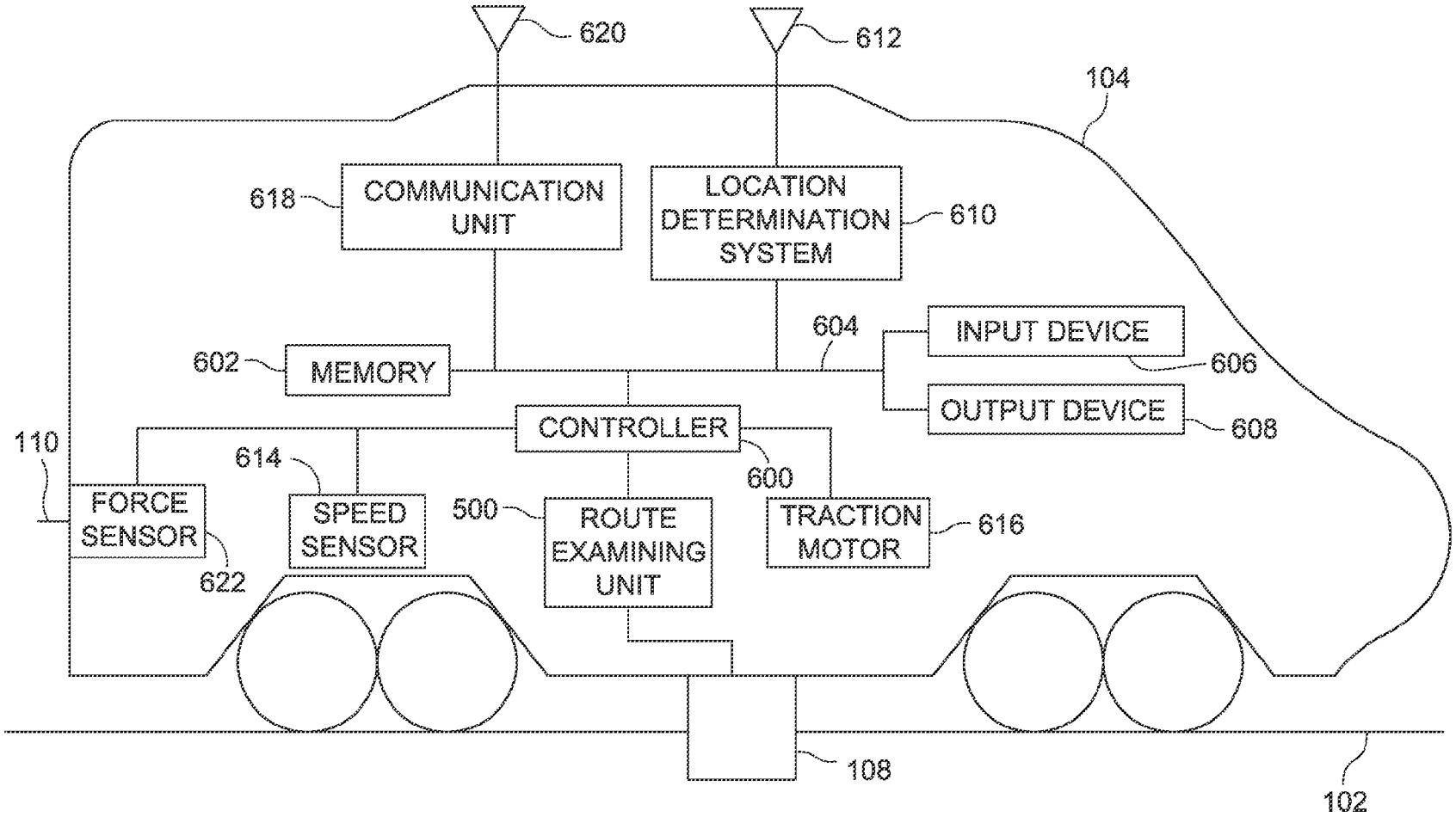
FIG. 6 is a schematic diagram of one embodiment of the vehicle shown in FIG. 1.

FIG. 6 is a schematic diagram of one embodiment of the powered vehicle 104. The vehicle 104 may represent the leading vehicle 104A, the trailing vehicle 104B, or another vehicle 104 shown in FIG. 1. The vehicle 104 includes a controller 600 that controls operations of the vehicle 104. The controller 600 may be embodied in hardware and/or software systems that operate to control operations of the vehicle 104 and/or vehicle system 100. The controller 600 may include one or more computer processors, controllers, and/or other logic-based devices that perform operations based on instructions stored on a tangible and non-transitory computer readable storage medium, such as a computer memory 602. Alternatively or additionally, the controller 600 may include a hard-wired device that performs operations based on hard-wired logic of a processor, controller, or other device.

The controller 600 is communicatively coupled (e.g., with one or more wired and/or wireless communication links 604) with various components used in operation of the vehicle 104 and/or vehicle system 100. The controller 600 is communicatively coupled with an input device 606 (e.g., levers, switches, touch screen, keypad, and the like) to receive manual input from an operator of the vehicle 104 or vehicle system 100 and an output device 608 (e.g., display device, speakers, lights, haptic device, and the like) to present information to the operator of the vehicle 104 or vehicle system 100. The input device 606 may be used by the operator to manually control when one or more of the sensors 108 of the sensing system 200 (shown in FIG. 2) collect inspection data of the route 102, the resolution of the inspection data that is collected, the amount of inspection data that is collected, the type of inspection data that is acquired, and the like. The input device 606 may be used by the operator to manually confirm identification of potential damage to the route 102 based on the inspection data. The output device 608 can present information concerning the potential damage to the route 102 to the operator, such as the location of the section of interest 300, information representative of the inspection data (e.g., video, images, numbers, values, and the like, of the inspection data).

A location determination system 610 is communicatively coupled with the controller 600. The location determination system 610 obtains data representative of actual locations of the vehicle system 100 and/or the vehicle 104. The location determination system 610 may wirelessly receive signals using transceiver and associated circuitry (shown as an antenna 612 in FIG. 6), such as signals transmitted by Global Positioning System satellites, signals transmitted by cellular networks, and the like. The location determination system 610 may use these signals to determine the location of the vehicle system 100 and/or vehicle 104, and/or convey the signals to the controller 600 for determining the location of the vehicle system 100 and/or vehicle 104. In another embodiment, the location determination system 610 may receive speed data indicative of the velocity of the vehicle system 100 from a speed sensor 614 of the vehicle 104 (or another vehicle 104, 106 in the vehicle system 100). The location determination system 610 may determine the velocity of the vehicle system 100 based on the speed data and can use an amount of time elapsed since passing or leaving a designated location in order to determine the current location of the vehicle system 100 or vehicle 104. As described above, the route examining unit 500 (shown in FIG. 5) of the sensing system 200 may communicate with the location determination system 610 to obtain the location of the vehicle 104 when the sensor 108 identifies potential damage to the route 102 in one embodiment.

The controller 600 is communicatively coupled with a propulsion system that includes one or more traction motors (shown as "Traction Motor 616") in FIG. 6) for providing tractive effort to propel the vehicle 104. Although not shown in FIG. 6, the propulsion system may be powered from an on-board power source (e.g., engine and alternator, battery, and the like) and/or an off-board power source (e.g., electrified rail, catenary, and the like). The controller 600 can communicate control signals to the propulsion system to control the speed, acceleration, and the like, of the vehicle 104. The control signals may be based off of manual input received from the input device 606 and/or may be autonomously generated.

For example, when the route examining unit 500 identifies potential damage to the route 102, the route examining unit 500 may direct the controller 600 to change movement of the vehicle system 100. The route examining unit 500 may direct the controller 600 to slow down movement of the vehicle system 100 in response to identification of the potential damage to the route 102 by the leading sensor 108A. The controller 600 may then autonomously control the propulsion system of the vehicle 104 to slow down movement of the vehicle 104. With respect to other vehicles 104, 106 in the vehicle system 100, the controller 600 may transmit control signals to other vehicles 104 that direct the vehicles 104 also to autonomously slow down movement. A communication unit 618 (e.g., transceiver circuitry and hardware, such as a wireless antenna 620) may be communicatively coupled with the controller 600 to communicate these control signals to the other vehicles 104 in the vehicle system 100 so that the other vehicles 104 slow down movement of the vehicle system 100. Additionally or alternatively, the communication unit 618 may communicate with the other vehicles 104, 106 via one or more wired connections extending through the vehicle system 100. In another embodiment, the controller 600 may generate and communicate command signals to the output device 608 that cause the output device 608 to present information to the operator of the vehicle system 100 to manually control the vehicle system 100 to slow down the vehicle system 100.

A force sensor 622 is connected with the coupler device 110 for measuring force data of the coupler device 110. The force data may represent or be indicative of the amount of slack between the illustrated vehicle 104 and another vehicle 104 or 106 coupled with the illustrated vehicle 104 by the coupler device 110. For example, the force data may represent tensile or compressive forces exerted by the coupler device 110. Additionally or alternatively, the force data can include distance measurements to the other vehicle 104, 106 that is coupled with the illustrated vehicle 104, which may represent or be indicative of the slack in the coupler device 110. Additional force sensors 602 may be disposed onboard other vehicles 104, 106 in the vehicle system 100 to measure the force data of the coupler devices 110 joining the other vehicles 104, 106. The force data may be communicated to the illustrated vehicle 104 via the communication unit 618.

The force data can be communicated to the route examining unit 500 to be monitored, as described above. If the route examining unit 500 determines that the slack between vehicles 104, 106 is to be changed (e.g., increased or reduced) in response to identification of potential damage to the route 102 by the leading sensor 108A, then the route examining unit 500 can direct the controller 600 to change movement of the vehicle system 100 to effectuate the change in slack. The controller 600 can transmit signals to the propulsion system of the illustrated vehicle 104 and to other vehicles 104, 106 in the vehicle system 100 to autonomously apply braking and/or tractive effort to alter the slack between the vehicles 104, 106 as requested by the route examining unit 500. Alternatively, the controller 600 may generate and communicate command signals to the output device 608 that cause the output device 608 to present information to the operator of the vehicle system 100 to manually control the vehicle system 100 to change the slack in the vehicle system 100, such as by stretching out the coupler devices 110 to reduce slack in the vehicle system 100.

In one embodiment, the route examining unit 500 may communicate with an off-board location, such as a dispatch center, a repair or maintenance facility, and the like, when potential damage to the route 102 is identified. For example, in response to the route examining unit 500 identifying potential damage to the route 102 based on the inspection data obtained by the leading sensor 108A and/or the damage being confirmed by examination of the additional inspection data obtained by the trailing sensor 108B, the route examining unit 500 may transmit a signal to the off-board location to request repair to the damaged portion 204 of the route 102. This signal may communicate the location of the section of interest 300, the location of the actually damaged portion 204, the time at which the damage was identified, and/or an identification of the type or category of damage (e.g., external cracks, internal cracks, external pitting, internal voids, displacement of tracks, and the like) to the off-board location via the communication unit 618. The type or category of damage can represent a classification of the damage. For example, one category of damage may be external damage to the route 102 (e.g., damage that is on an exterior surface and/or extends to the exterior surface), while another category includes interior damage (e.g., damage that is inside the route 102 and not on the exterior surface). As another example, other categories of damage may be defined by the evidence of the damage, such as categories of cracks, pits, voids, and the like. Alternatively, other categories may be used. The off-board location can then send a repair crew to fix and/or replace the damaged portion 204 of the route 102.

In another embodiment, the route examining unit 500 may communicate with another vehicle or vehicle system (that is not coupled with the vehicle system 100) to warn the other vehicle or vehicle system of the damaged portion 204 of the route 102. For example, in response to the route examining unit 500 identifying potential damage to the route 102 based on the inspection data obtained by the leading sensor 108A and/or the damage being confirmed by examination of the additional inspection data obtained by the trailing sensor 108B, the route examining unit 500 may transmit a signal to one or more other vehicles or vehicle systems traveling on the route 102 to warn the other vehicles or vehicle systems of the damaged portion 204 of the route 102. The signal may be transmitted to designated vehicles or vehicle systems (e.g., addressed to specific vehicles or vehicle systems as opposed to broadcast to any or several vehicles or vehicle systems within range) using the communication unit 618. Alternatively, the signal may be broadcast for reception by any vehicles or vehicle systems within range of communication, as opposed to being addressed and sent to specific vehicles or vehicle systems. This signal may communicate the location of the section of interest 300, the location of the actually damaged portion 204, the time at which the damage was identified, and/or an identification of the type of damage (e.g., external cracks, internal cracks, external pitting, internal voids, displacement of tracks, and the like) to the off-board location via the communication unit 618. The vehicles or vehicle systems that receive the signal may then adjust travel accordingly. For example, the vehicles or vehicle systems may change course to avoid traveling over the damaged portion 204, may slow down when traveling over the damaged portion 204, and the like.

Figure 7:
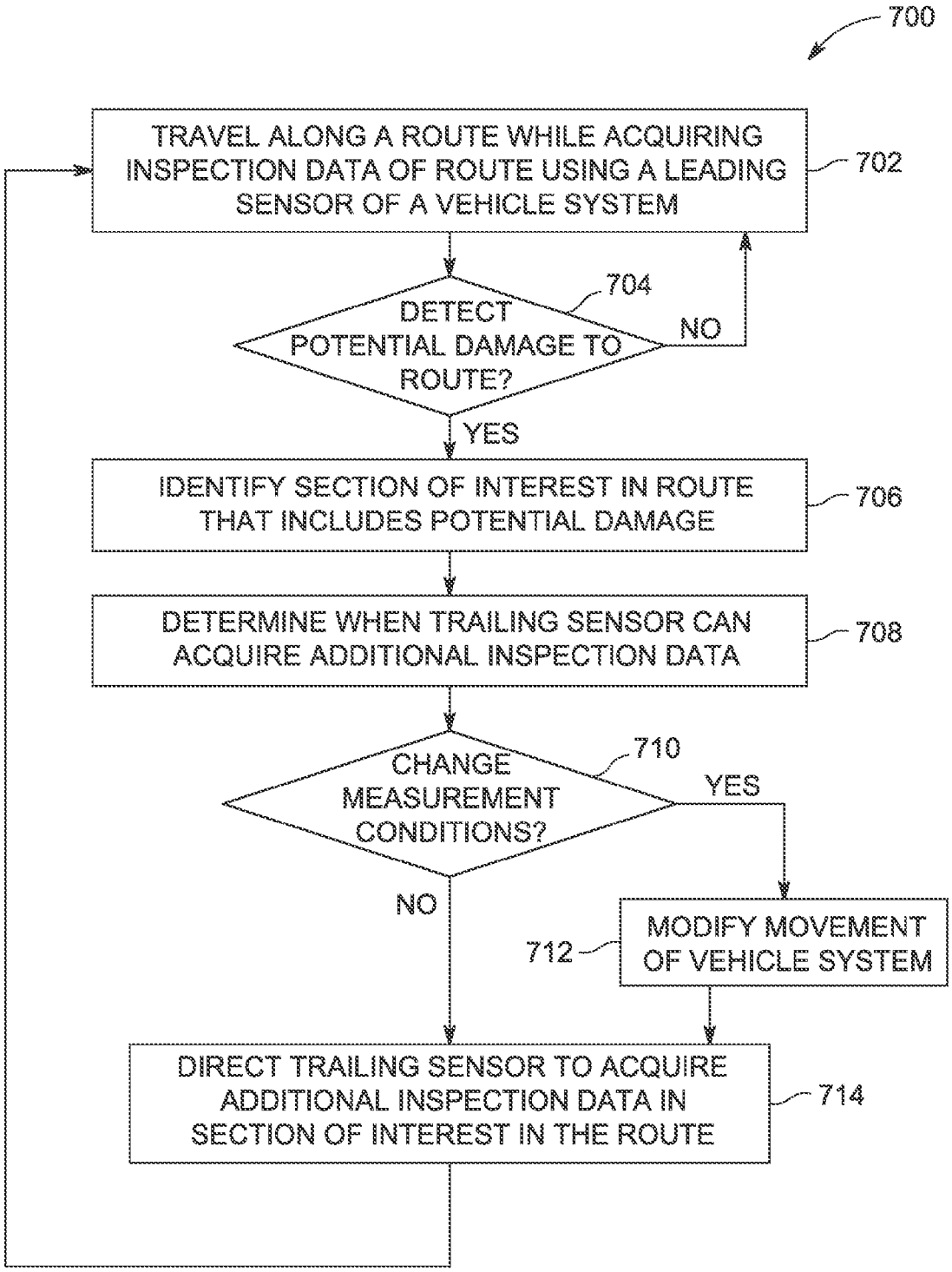
FIG. 7 is a flowchart of one embodiment of a method for obtaining inspection data of a potentially damaged route.

FIG. 7 is a flowchart of one embodiment of a method 700 for obtaining inspection data of a potentially damaged route. The method 700 may be used in conjunction with one or more embodiments of the sensing system 200 (shown in FIG. 2). For example, the method 700 may be used to acquire inspection data of the route 102 (shown in FIG. 1) from plural sensors 108 (shown in FIG. 1) or arrays of sensors 108 in the vehicle system 100 during a single pass of the vehicle system 100 over the route 102.

At 702, the vehicle system 100 travels along the route 102 while acquiring inspection data of the route 102 using the leading sensor 108A of the vehicle system 100. As described above, the leading sensor 108A may acquire the inspection data periodically, continuously, and/or when manually or autonomously prompted to collect the data.

At 704, a determination is made as to whether the inspection data obtained by the leading sensor 108A is indicative of potential damage to the route 102. As described above, the route examining unit 500 (shown in FIG. 5) can determine if the inspection data from the leading sensor 108A represents damage to the route 102. If the inspection data does not indicate potential damage to the route 102, then additional inspection data may not need to be acquired by the trailing sensor 108B. As a result, flow of the method 700 may return to 702, where additional inspection data of the route 102 is obtained. If the inspection data does indicate potential damage to the route 102, however, then additional inspection data may be acquired by the trailing sensor 108B. As a result, flow of the method 700 may continue to 706.

At 706, the section of interest 300 (shown in FIG. 3) of the route 102 is identified. As described above, the section of interest 300 is identified to include the portion of the route 102 that includes the potential damage. The section of interest 300 may be identified by determining the location of the leading sensor 108A when the inspection data that is indicative of the potential damage was acquired.

At 708, the time at which the trailing sensor 108B is to acquire additional inspection data of the section of interest 300 in the route 102 is determined. This time may be determined based on the separation distance 400 (shown in FIG. 4) and the velocity of the vehicle system 100. Additionally or alternatively, this time may be determined based on the separation distance 400 and a designated upcoming change in the velocity of the vehicle system 100, such as when the controller 202 (shown in FIG. 2) directs the vehicle system 100 to slow down for the trailing sensor 108B, as described above.

At 710, a determination is made as to whether measurement conditions of the vehicle system 100 are to be changed for the trailing sensor 108B. For example, a decision may be made as to whether the vehicle system 100 should slow down to increase the resolution and/or amount of the additional inspection data acquired by the trailing sensor 108B. This decision may additionally or alternatively include a determination of whether to reduce slack in the coupler devices 110 of the vehicle system 100 to stretch the vehicle system 100 and reduce false readings by the trailing sensor 108B. For example, reducing slack and stretching the vehicle system 100 may eliminate false readings that may occur with the trailing sensor 108B when the trailing vehicle 104B suddenly jerks or accelerates relative to the other vehicles 104, 106.

If the measurement conditions of the vehicle system 100 are to be changed, then the movement of the vehicle system 100 may need to be modified. As a result, flow of the method 700 may proceed to 712. Otherwise, flow of the method 700 may continue to 714.

At 712, movement of the vehicle system 100 is modified, such as by slowing down speed of the vehicle system 100 and/or changing slack of the vehicle system 100. As described above, reducing the velocity of the vehicle system 100 may allow more time for the trailing sensor 108B to acquire the additional inspection data. Reducing the slack of the vehicle system 100 (e.g., between the trailing vehicle 104B and/or one or more other vehicles 104, 106) may reduce false readings made by the trailing sensor 108B. For example, reducing the slack can stretch the vehicle system 100 so that the trailing vehicle 104B and the trailing sensor 108B are not suddenly moved relative to the route 102.

At 714, the trailing sensor 108B is directed to acquire additional inspection data in the section of interest 300 of the route 102. The trailing sensor 108B may be directed to acquire the data at a time when the trailing sensor 108B passes over the section of interest 300. In one embodiment, the trailing sensor 108B may only be activated to acquire the additional inspection data when the section of interest 300 is identified based on the inspection data acquired by the leading sensor 108A.

The inspection data acquired by the leading sensor 108A and/or the trailing sensor 108B may be used to identify and/or characterize damage to the route 102. Acquiring different types of inspection data, acquiring different amounts of inspection data, acquiring the inspection data at different resolutions, and the like, during a single pass of the vehicle system 100 over the potentially damaged portion of the route 102 can be more efficient than using multiple, different, and/or separate systems or vehicle systems to examine the route 102.

In one example of operation of the sensing system 200, the sensors 108A and/or 108B acquire characteristics of the route that are represented by inspection signatures as the vehicle system 100 travels along the route 102. The inspection signatures can be formed by the route examining unit and can represent the data obtained by the sensors 108 that are indicative of whether or not the route 102 is damaged. For example, the inspection signatures can represent electrical characteristics of a conductive rail of the route 102 that are measured at different times and/or distances when an electric current is injected into the rail and/or when the rail is exposed to a controlled magnetic field. These electrical characteristics can be measured at a first location along the rail (that moves along the rail with the vehicle system 100) and can include the voltage, amps, frequency, resistance, impedance, or other measurement of the current that is injected into the rail at a different, second location along the rail (which also moves along the rail with the vehicle system 100) and that is at least partially conducted by the rail. Optionally, the rail can be exposed to a magnetic field and the electrical characteristics that are measured and used to form the inspection signatures can be the magnitude (e.g., amps and/or volts) of eddy currents induced in the rail by the magnetic field. As another example, the inspection signatures can represent ultrasound echoes (e.g., the magnitude and/or frequencies of the echoes) that are measured by an ultrasound probe responsive to ultrasound waves are transmitted into the route.

In another example of the inspection signatures, the inspection signatures can represent distances that are measured to one or more surfaces of the route 102. For example, a laser light can emit light toward the route 102 or a mechanical probe can engage the route 102 and the reflected light or displacement of the mechanical probe can be used to measure the distance between the source of the light or a fixed point of the mechanical probe and the route 102. The inspection signatures can represent these measured distances with respect to distance along the route 102 and/or time. As another example, the inspection signatures can represent acoustics (e.g., sounds) measured by one or more acoustic pick up devices (e.g., microphones) over time. The vehicle system 100 can generate sounds when wheels of the vehicle system 100 travel over the route 102 and/or damage to the route 102. These sounds can be represented with respect to time or distance along the route 102 in the inspection signatures.

Figure 8:
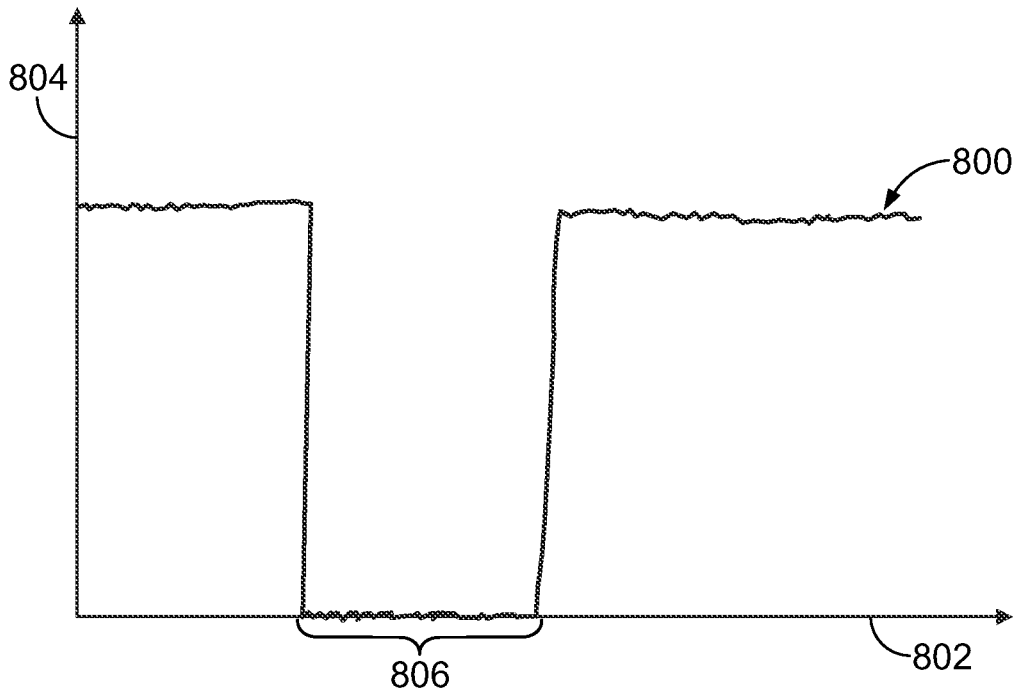
FIG. 8 illustrates one example of an inspection signature of the route shown in FIG. 1.

FIG. 8 illustrates one example of an inspection signature 800 of the route 102 (shown in FIG. 1). The inspection signature 800 is shown alongside a horizontal axis 802 representative of time or distance (e.g., distance along the route 102) and a vertical axis 804 representative of magnitude of the characteristic of the route 102 being measured by the sensor 108A or 108B (shown in FIG. 1). In one aspect, the inspection signature 800 can represent one or more electrical characteristics of an electric current that is at least partially conducted by the route 102 (e.g., by a rail of the route 102), such as voltage or amplitude of the current.

Figure 9:
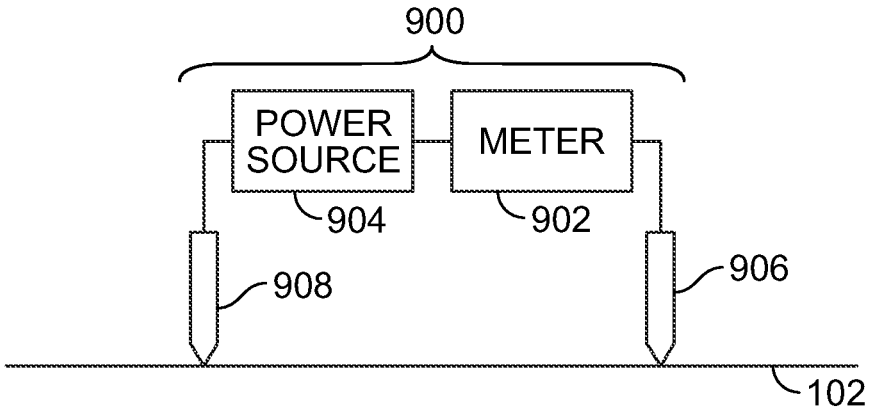
FIG. 9 is a schematic illustration of one version of a sensor that can be used to measure the electrical characteristics of the route shown in FIG. 1 for creation of inspection signatures.

FIG. 9 is a schematic illustration of one version of a sensor 900 that can be used to measure the electrical characteristics of the route 102 for creation of inspection signatures, such as the inspection signature 800 shown in FIG. 8. The sensor 900 can represent the leading sensor 108A (shown in FIG. 1), the trailing sensor 108B (shown in FIG. 1), or each of the leading sensor 108A and the trailing sensor 108B. The sensor 900 includes two electrical probes 906, 908 that contact or are disposed very close to the route 102 at different locations along the route 102. For example, the probes 906, 908 may be spaced apart from each other along the length of the route 102. The probes 906, 908 are connected with the vehicle system 100 (shown in FIG. 1) so that the probes 906, 908 move along the route 102 during movement of the vehicle system 100 along the route 102.

One probe 908 can be referred to as an injecting probe that applies an electric current to the route 102. For example, the probe 908 can be coupled with a power source 904 that supplies electric current (e.g., direct current and/or alternating current) to the probe 908 for applying the current to the route 102, such as a rail of the route 102. The power source 904 may include or represent a battery, fuel cell, alternator, generator, or other source of electric current disposed onboard the vehicle system 100. Optionally, the power source 904 can represent an off-board source of the electric current (e.g., an overhead catenary, electrified rail of the route 102, or the like). Optionally, the probe 908 may be referred to as an inducing probe that generates a magnetic field within and/or around the route 102, such as in and/or around a rail of the route 102. This magnetic field can induce an electric current in the route 102. For example, eddy currents may be created in the rail of the route 102 by the magnetic field.

The other probe 906 can be referred to as a measuring probe that measures one or more electrical characteristics of the route 102. For example, the probe 906 can be coupled with a meter 902 that measures the voltage, amps, frequency, or other characteristic of the electric current that is injected into the route 102 by the probe 908. Optionally, the probe 906 and meter 902 can measure the voltage, amps, frequency, or other characteristic of the eddy currents that are induced in the route 102 by the probe 908. In another aspect, the probe 906 can measure the resistance, impedance, or other characteristic of the route 102 using the current that is injected into or induced in the route 102 by the probe 908. With respect to the inspection signature 800 shown in FIG. 8, the signature 800 can represent electrical characteristics of the route 102 as measured by the sensor 900 shown in FIG. 9, such as the voltage or amps of the current that is injected into the route 102 or that is induced in the route 102.

Figure 10:
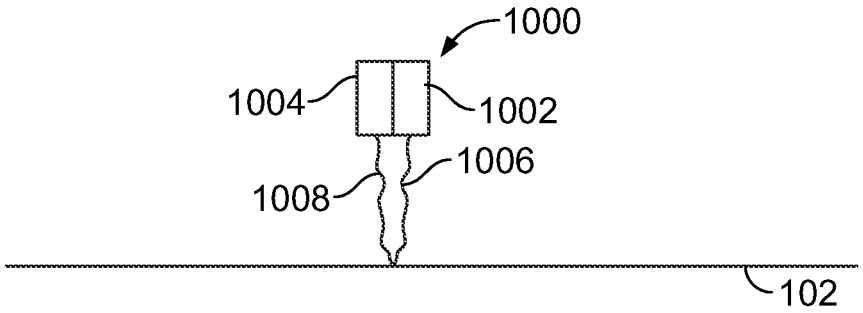
FIG. 10 is a schematic illustration of another version of a sensor that can be used to measure distance characteristics of the route shown in FIG. 1 for creation of inspection signatures.

FIG. 10 is a schematic illustration of another version of a sensor 1000 that can be used to measure distance characteristics of the route 102 for creation of inspection signatures, such as the inspection signature 800 shown in FIG. 8. The sensor 1000 can represent the leading sensor 108A (shown in FIG. 1), the trailing sensor 108B (shown in FIG. 1), or each of the leading sensor 108A and the trailing sensor 108B. The sensor 1000 includes a light emission device 1002, such as a laser or other light source, and an optical receiver 1004, such as an optical sensor that detects receipt of the laser or other light.

The light emission device 1002 generates light 1006 toward the route 102. This light 1006 is at least partially reflected off the route 102 as reflected light 1008. The receiver 1004 can sense this reflected light 1008 and determine a distance between the sensor 1000 and the route 102. For example, based on the time of flight of the light 1006 toward the route 102 and the reflected light 1008 back to the receiver 1004, the sensor 1000 can determine how far the sensor 1000 is from the route 102. When the surface of the route 102 off of which the light 1006 is reflected changes, such as due to damage or displacement of the route 102, then this distance can change. With respect to the inspection signature 800 shown in FIG. 8, the signature 800 can represent distances between the sensor 1000 and the route 102 as measured by the sensor 1000 shown in FIG. 10. Alternatively, one or more of the devices 1002, 1004 can represent ultrasound transducers that emit ultrasound waves (e.g., as 1006 in FIG. 10) toward and/or into the route 102 and that sense ultrasound echoes of the waves (e.g., as 1008 in FIG. 10) that are reflected off of the route 102.

Figure 11:
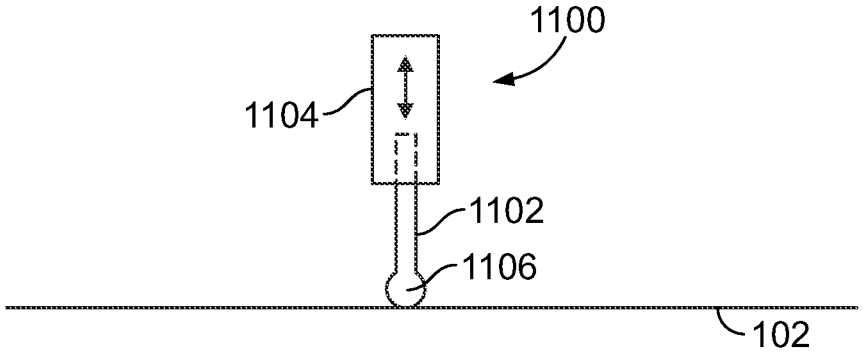
FIG. 11 is a schematic illustration of another version of a sensor that can be used to measure distance characteristics of the route shown in FIG. 1 for creation of inspection signatures.

FIG. 11 is a schematic illustration of another version of a sensor 1100 that can be used to measure distance characteristics of the route 102 for creation of inspection signatures, such as the inspection signature 800 shown in FIG. 8. The sensor 1100 can represent the leading sensor 108A (shown in FIG. 1), the trailing sensor 108B (shown in FIG. 1), or each of the leading sensor 108A and the trailing sensor 108B. The sensor 1100 includes a mechanical probe 1102 that engages the route 102 and a displacement sensor 1104. An engagement end 1106 of the probe 1102 engages the route 102 and may move up and down as the vehicle system 100 (shown in FIG. 1) moves along the route 100 when the surface of the route 102 on which the end 1106 is moving moves up or down. The probe 1102 is able to move up and down within the sensor 1104 as the distance between the route 102 and the sensor 1104 changes (due to displacements of the route 102). The sensor 1104 can monitor how far the probe 1102 moves relative to the sensor 1104 in order to measure changes in the distance between the route 102 and the sensor 1104. With respect to the inspection signature 800 shown in FIG. 8, the signature 800 can represent distances or changes in the distances between the sensor 1104 and the route 102.

Returning to the description of the inspection signature 800 shown in FIG. 8, the inspection signature 800 can be generated by the monitoring module 504 (shown in FIG. 5). In one aspect, the monitoring module 504 generates an output signal representative of the inspection signature 800. The output signal can be sent to an output device, such as a display device, for presentation of the inspection signature 800 to an operator of the vehicle system 100.

The inspection signature 800 can represent one or more of the characteristics described above with respect to time or distance as the vehicle system 100 (shown in FIG. 1) moves along the route 102 (shown in FIG. 1). For example, with respect to the sensor 900 shown in FIG. 9, the inspection signature 800 can represent voltages, amps, or other measurements of electric currents conducted by the route 102, or another characteristic. With respect to the sensors 1000, 1100 shown in FIGS. 10 and 11, the inspection signature 800 can represent distances or changes in distances between the sensors 1000, 1100 and the route 102. Optionally, the inspection signature 800 can represent magnitudes of ultrasound echoes measured by an ultrasound transducer.

As shown in FIG. 8, the inspection signature 800 exhibits a decrease in the measured characteristics over a time period or distance segment 806 of the route 102. Prior to and/or following this time period or distance segment 806, the characteristics may remain constant or substantially constant (e.g., with some noise from the sensor 108). During this time period or distance segment 806, the characteristics may sharply decrease and/or be eliminated (e.g., decrease to zero or otherwise decrease by an amount that is larger than noise in the measurements). This decrease may be identified by the identification module 506 (shown in FIG. 5) as being indicative of a damaged section of the route 102. For example, the identification module 506 may determine that when the characteristics measured by the sensor 108A and/or 108B decreases by at least a designated, non-zero amount, the inspection signature 800 indicates potential damage to the route 102 in a location that corresponds to where the sensor was located when the characteristics of the time period or distance segment 806 were measured.

Figure 12:
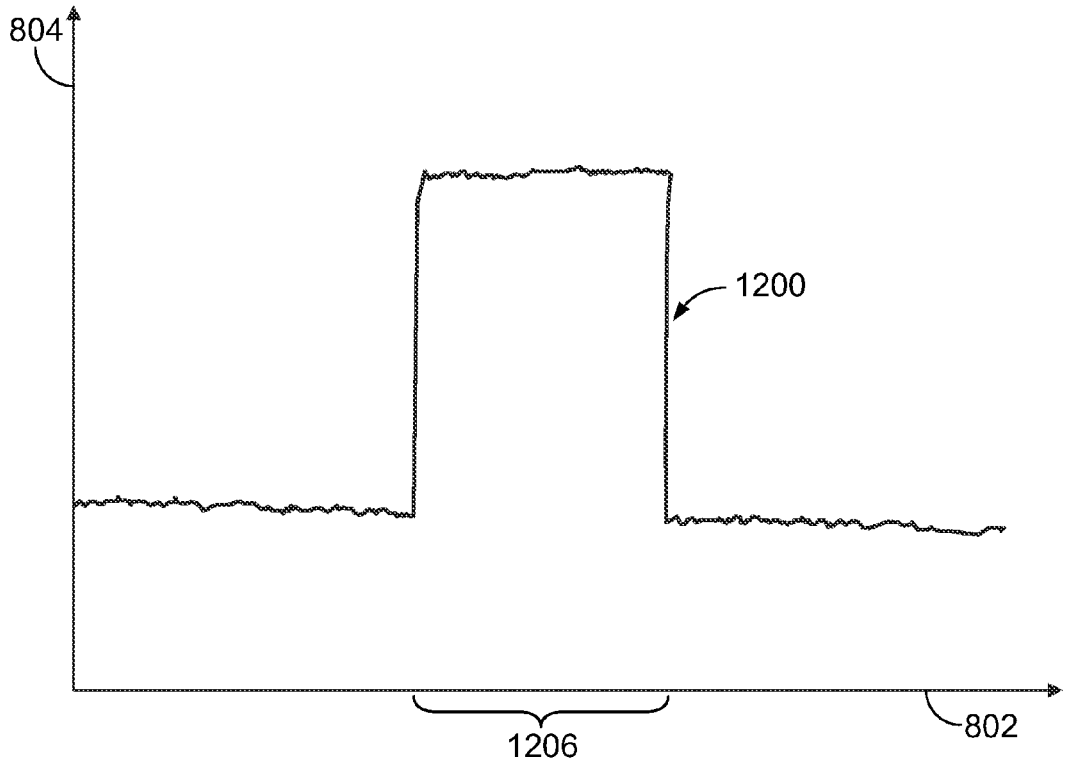
FIG. 12 illustrates another example of an inspection signature of the route shown in FIG. 1.

FIG. 12 illustrates another example of an inspection signature 1200 of the route 102 (shown in FIG. 1). The inspection signature 1200 is shown alongside the horizontal axis 802 and the vertical axis 804 described above. The inspection signature 1200 can be generated by the monitoring module 504 (shown in FIG. 5). In one aspect, the monitoring module 504 generates an output signal representative of the inspection signature. The output signal can be sent to an output device, such as a display device, for presentation of the inspection signature to an operator of the vehicle system 100 (shown in FIG. 1).

The inspection signature 1200 can represent one or more of the characteristics described above with respect to time or distance as the vehicle system 100 moves along the route 102. For example, with respect to the sensor 900 shown in FIG. 9, the inspection signature 1200 can represent impedances, resistances, or other measurements of the route 102, or another characteristic. With respect to the sensors 1000, 1100 shown in FIGS. 10 and 11, the inspection signature 1200 can represent distances or changes in distances between the sensors 1000, 1100 and the route 102. Optionally, the inspection signature 1200 can represent magnitudes of ultrasound echoes measured by an ultrasound transducer.

The inspection signature 1200 includes an increase in the measured characteristics over the time period or distance segment 1206 of the route 102. Prior to and/or following this time period or distance segment 806, the characteristics may remain constant or substantially constant (e.g., with some noise from the sensor 108). During the time period or distance segment 1206, the characteristics may sharply increase (e.g., increase by at least a threshold, non-zero amount or otherwise increase by an amount that is larger than noise in the measurements). This increase may be identified by the identification module 506 (shown in FIG. 5) as being indicative of a damaged section of the route 102. For example, the identification module 506 may determine that when the characteristics measured by the sensor 108A and/or 108B increases by at least a designated, non-zero amount, the inspection signature 1200 indicates potential damage to the route 102 in a location that corresponds to where the sensor was located when the characteristics of the time period or distance segment 1206 were measured.

Figure 13:
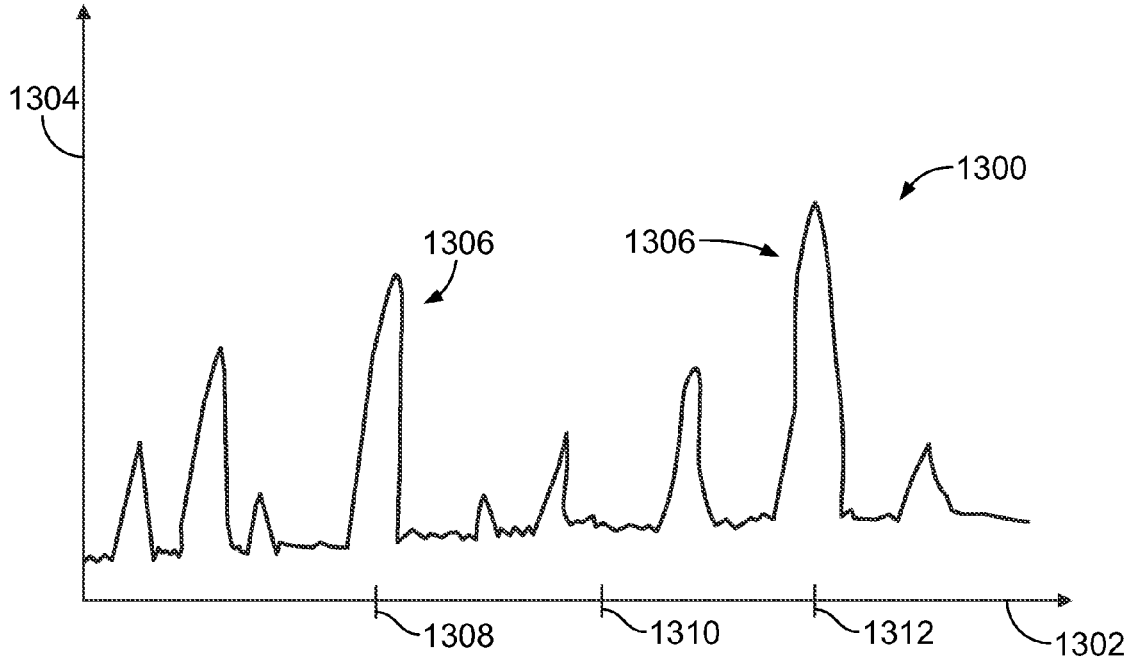
FIG. 13 illustrates another example of an inspection signature of the route shown in FIG. 1.

FIG. 13 illustrates another example of an inspection signature 1300 of the route 102 (shown in FIG. 1). In contrast to the time domain or distance domain inspection signatures 800, 1200 shown in FIGS. 8 and 12, the inspection signature 1300 may be a frequency spectrum of measured characteristics of the route 102. The signature 1300 is shown alongside a horizontal axis 1302 representative of frequencies and a vertical axis 1304 representative of magnitudes of the measured characteristics at the various frequencies.

The monitoring module 504 (shown in FIG. 5) can create the inspection signature 1300 from the characteristics of the route 102 as measured by one or more of the sensors described herein. For example, the inspection signature 1300 can represent sounds detected by a microphone of the sensor 108A and/or 108B. The identification module 506 (shown in FIG. 5) can identify a damaged section of the route 102 based on the inspection signature 1300 and/or changes in the inspection signature 1300. For example, the identification module 506 may examine the inspection signature 1300 to determine if the inspection signature 1300 includes a peak 1306 at one or more frequencies of interest 1308, 1310, 1312 or within designated ranges of the frequencies of interest 1308, 1310, 1312. Additionally or alternatively, the identification module 506 can examine the inspection signature 1300 and/or one or more other inspection signatures 1300 to determine if the magnitude of the peak 1306 at one or more frequencies of interest 1308, 1310, 1312 changes. The presence or absence of peaks 1306 at one or more of the frequencies of interest 1308, 1310, 1312, and/or changes in the magnitudes of the peaks 1306 may indicate that the route 102 has a damaged section in locations associated with the peaks 1306.

In one example operation of the sensing system 200 (shown in FIG. 2), if the identification module 506 (shown in FIG. 5) is able to identify a section of the route 102 as being damaged from the inspection signature obtained by the leading sensor 108A, then the sensing system 200 can take one or more remedial actions, such as slowing or stopping movement of the vehicle system 100, communicating a warning to one or more other vehicle systems, communicating a signal to an off-board location to request further inspection and/or maintenance of the route 102, automatically controlling slack in the vehicle system 100, or the like. If the inspection signature obtained by the leading sensor 108A does not indicate damage to the route 102, the identification module 506 may still identify the section of the route 102 as being damaged from the inspection signature obtained by one or more of the trailing sensors 108B. The sensing system 200 can then take one or more of the remedial actions described above, even though the inspection signature from the leading sensor 108A did not clearly indicate damage to the route 102.

The identification module 506 can examine the inspection signatures obtained by different sensors 108 to determine if the vehicle system 100 has a defect that potentially damaged the route 102. The identification module 506 can examine the inspection signatures obtained by the leading and trailing sensors 108A, 108B. If the inspection signature from the leading sensor 108A does not indicate damage or potential damage to the route 102, but the inspection signature from the trailing sensor 108B does indicate damage or potential damage to the route 102, then the identification module 506 can determine that the vehicle system 100 may have a defect that damaged the route 102 during travel of the vehicle system 100 over the route 102, such as a flat wheel or broken wheel. The sensing system 200 may then communicate a signal to an off-board location to request inspection or maintenance of the vehicle system 100 at an upcoming location.

If, however, the identification module 506 is unable to clearly identify the damaged section of the route 102 from the inspection signatures obtained by the sensors 108A, 108B, but does identify some changes in one or more of the inspection signatures that are indicative of damage to the route 102, then the identification module 506 may compare one or more inspection signatures obtained by the leading sensor 108A with one or more inspection signatures obtained by one or more of the trailing sensors 108B in order to confirm or refute the potential identification of a damaged section of the route 102.

For example, with respect to the inspection signature 800 (shown in FIG. 8), the identification module 506 may determine that the section of the route 102 that corresponds to the measured characteristics associated with the decrease in the signature 800 is damaged when the measured characteristics in the signature 800 decrease by at least a designated, non-zero threshold amount. If the characteristics decrease, but not by an amount that is at least as large as this threshold amount, then the identification module 506 may determine that the section of the route 102 is potentially damaged. With respect to the inspection signature 1200 (shown in FIG. 12), the identification module 506 may determine that the section of the route 102 that corresponds to the measured characteristics associated with the increase in the signature 1200 is damaged when the measured characteristics in the signature 1200 increase by at least a designated, non-zero threshold amount. If the characteristics increase, but not by an amount that is at least as large as this threshold amount, then the identification module 506 may determine that the section of the route 102 is potentially damaged. With respect to the inspection signature 1300 (shown in FIG. 13), the identification module 506 may determine that the section of the route 102 is damaged when the measured characteristics for that section are represented by a peak 1306 and/or a change in a peak 1306 that is at least as large as a designated, non-zero threshold amount. If the peak 1306 is present, but is not as large as this threshold or the change in the peak 1306 is not as large as this threshold, then the identification module 506 may determine that the section of the route 102 is potentially damaged.

In the event that the inspection signatures from one or more of the sensors 108 indicates potential damage but do not definitively indicate damage (e.g., the increase or decrease in the measured characteristics does not exceed a first designated, non-zero threshold), then the identification module 506 can compare the inspection signatures to confirm or refute the identification of potential damage. In one aspect, the identification module 506 may normalize the inspection signatures obtained by different sensors 108A, 108B, divide the inspection signatures obtained by the different sensors 108A, 108B into smaller portions, temporally or spatially correlate the smaller portions of the inspection signatures obtained by the different sensors 108A, 108B with each other, and compare these normalized and/or correlated portions obtained by the different sensors 108A, 108B with each other. Based on this comparison, the identification module 506 may determine that the route 102 includes a damaged section (e.g., confirm the potential identification of the damaged section of the route 102 from one or more of the inspection signatures) or determine that the route 102 does not include the damaged section (e.g., refute the potential identification of the damaged section of the route 102).

Figure 14:
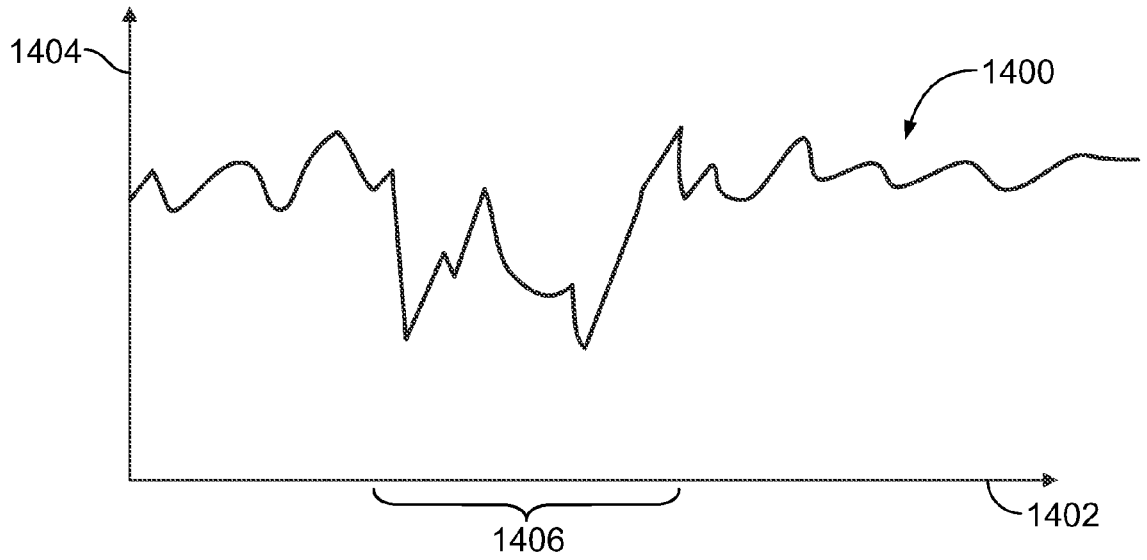
FIG. 14 illustrates a first inspection signature obtained by the leading sensor shown in FIG. 1 according to one example of comparing inspection signatures to identify a damaged section of the route shown in FIG. 1.

FIG. 14 illustrates a first inspection signature 1400 obtained by the leading sensor 108A (shown in FIG. 1) according to one example of comparing inspection signatures to identify a damaged section of the route 102 (shown in FIG. 1). The first inspection signature 1400 is shown alongside a horizontal axis 1402 representative of time or distance along the route 102 and a vertical axis 1404 representative of magnitudes of the characteristics being measured to generate the first inspection signature 1400.

As shown in FIG. 14, during a first time or distance window 1406 of the inspection signature 1400, the measured characteristics include one or more decreases. But, due to noise or other causes, the inspection module 506 (shown in FIG. 5) may be unable to positively identify the decreases as being indicative of a damaged section of the route 102. For example, the decreases in the measured characteristics may not exceed a designated, non-zero threshold.

Figure 15:
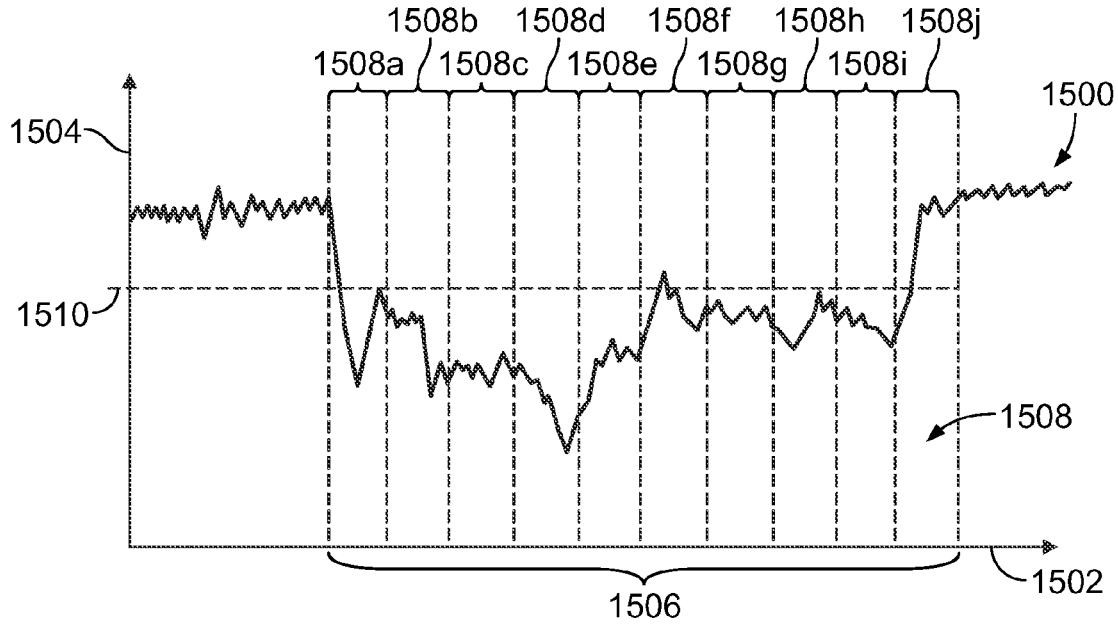
FIG. 15 illustrates a second inspection signature obtained by the trailing sensor shown in FIG. 1 according to one example of comparing inspection signatures to identify a damaged section of the route shown in FIG. 1.

FIG. 15 illustrates a second inspection signature 1500 obtained by the trailing sensor 108B (shown in FIG. 1) according to one example of comparing inspection signatures to identify a damaged section of the route 102 (shown in FIG. 1). The second inspection signature 1500 is shown alongside a horizontal axis 1502 representative of time or distance along the route 102 and a vertical axis 1504 representative of magnitudes of the characteristics being measured to generate the second inspection signature 1500.

As shown in FIG. 15, during a second time or distance window 1506 of the inspection signature 1500, the measured characteristics include one or more decreases. But, due to noise or other causes, the inspection module 506 (shown in FIG. 5) may be unable to positively identify the decreases as being indicative of a damaged section of the route 102. For example, the decreases in the measured characteristics may not exceed a designated, non-zero threshold.

With continued reference to both the first and second inspection signatures 1400, 1500 shown in FIGS. 14 and 15, the inspection module 506 may normalize the inspection signatures 1400, 1500 in order to compare the signatures 1400, 1500. The inspection signatures 1400, 1500 may be normalized by the route inspection unit by modifying (e.g., expanding or contracting) the time- and/or distance-scale of one or more of the inspection signatures 1400, 1500 so that the measured characteristics in the inspection signatures 1400, 1500 are measured for the same or substantially same section of the route 102. For example, the horizontal axes 1402, 1502 for the respective inspection signatures 1400, 1500 may represent different periods of time or different distances along the route 102. The inspection signatures 1400, 1500 may represent the characteristics measured over the same segment of the route 102, but one of the signatures 1400 or 1500 may extend over a longer or shorter time and/or distance along the route 102 than the other signature 1500 or 1400.

For example, the vehicle system 100 (shown in FIG. 1) may be traveling at a faster speed when the leading sensor 108A measured the characteristics for the first inspection signature 1400 than when the trailing sensor 108B measured the characteristics for the second inspection signature 1500

(or vice-versa). As a result, the second inspection signature 1500 may extend over a longer time period or distance along the route 102 than the first inspection signature 1400. This difference in speed also may cause the time period or distance 1406 in the first inspection signature 1400 to be shorter in duration or distance along the route 102 than the time period 1506 in the second inspection signature 1500. Optionally, the trailing sensor 108B may measure the characteristics of the route 102 at a greater resolution than the leading sensor 108A (or vice-versa). The difference in resolutions can cause one of the signatures (e.g., the second inspection signature 1500) to acquire more measurements of the characteristics and, as a result, extend over a longer portion of the horizontal axis 1502 than the horizontal axis 1402 of the first inspection signature 1400.

In order to compare the inspection signatures 1400, 1500, the inspection module 506 may scale one or more of the inspection signatures 1400, 1500 to match the scale of the other inspection signatures 1400, 1500. For example, the inspection module 506 may horizontally expand or stretch the portion of the inspection signature 1400 in the window 1406 so that this portion of the inspection signature 1400 extends over the same length of the horizontal axis 1402 that the window 1506 of the inspection signature 1500 extends over the horizontal axis 1502. Conversely, the inspection module 506 may compact the portion of the inspection signature 1500 in the window 1506 so that this portion of the inspection signature 1500 extends over the same length of the horizontal axis 1502 that the window 1406 of the inspection signature 1400 extends over the horizontal axis 1402. The inspection signatures 1400, 1500 may be scaled by a comparison of the time periods or distances over which the inspection signatures 1400, 1500 extend. As one example, if the window 1406 of the inspection signature 1400 extends over a time period of two seconds and the window 1506 of the inspection signature extends over a time period of five seconds, then the inspection module 506 may stretch (e.g., lengthen) the window 1406 of the inspection signature 1400 so that the window 1406 extends over the time period of five seconds. Conversely, the inspection module 506 may compact the window 1506 of the inspection signature 1500 so that this window 1506 extends of the time period of two seconds.

Figure 16:
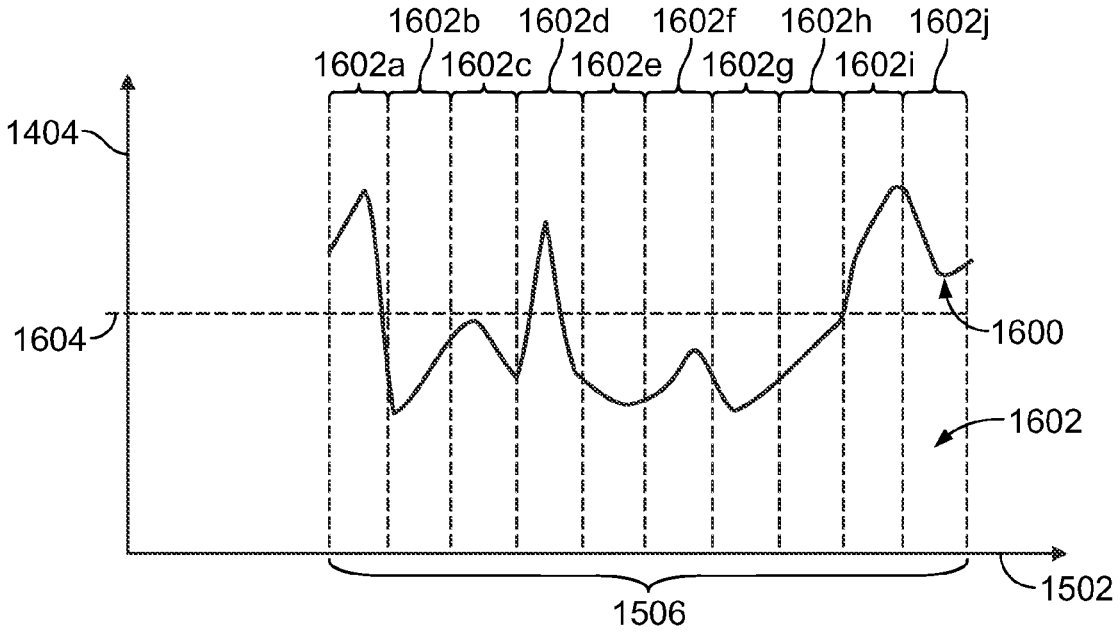
FIG. 16 illustrates one example of a scaled portion of the first inspection signature shown in FIG. 14.

FIG. 16 illustrates one example of a scaled portion 1600 of the first inspection signature 1400 shown in FIG. 14. The scaled portion 1600 of the first inspection signature 1400 represents the portion 1406 of the first inspection signature 1400 shown in FIG. 14. The scaled portion 1600 is shown alongside the horizontal axis 1502 described above in connection with the second inspection signature 1500 and the vertical axis 1404 described above in connection with the first inspection signature 1400. The scaled portion 1600 has been horizontally extended, or stretched, so that the scaled portion 1600 of the first inspection signature 1400 extends over the same segment of the horizontal axis 1502 as the portion 1506 of the second inspection window 1500. Optionally, the portion 1506 of the second inspection signature 1500 may be horizontally compacted, or shrunk, so that the portion 1506 horizontally extends over the same segment of the horizontal axis 1402 as the portion 1406 of the first inspection signature 1400.

In one aspect, the inspection module 506 may slice up the inspection signatures 1400, 1500 into smaller segments and then compare the portions of the inspection signature 1400 with the segments of the inspection signatures 1500. These segments of the inspection signatures 1400, 1500 may be referred to as slices of the inspection signatures 1400, 1500. In one embodiment, the inspection module 506 scales and then divides one or more of the inspection signatures 1400, 1500 into the slices. Optionally, the inspection module 506 may divide up the inspection signatures 1400, 1500 into the slices without scaling the inspection signatures 1400, 1500.

For example, in FIG. 16, the inspection module 506 can divide at least the scaled portion 1600 of the first inspection signature 1400 into separate, non-overlapping slices 1602 (e.g., slices 1602*a-j*). Alternatively, the inspection module 506 can divide the non-scaled portion 1406 (shown in FIG. 14) of the first inspection signature 1400 into the slices 1602. Although ten slices 1602 are shown in FIG. 16, optionally, the inspection module 506 may divide at least the portion 1600 or 1406 into a different number of slices 1602. While the slices 1602 do not overlap each other in FIG. 16, alternatively, one or more of the slices 1602 may overlap one or more other slices 1602.

The slices 1602 may horizontally extend along the horizontal axis (the axis 1502 for the slices 1602 of the scaled portion 1600 or the axis 1402 for the slices 1602 of the portion 1406) for equal distances or time periods. For example, the slices 1602 may have the same width dimensions. Alternatively, one or more of the slices 1602 may have a different width dimension along the horizontal axis than one or more other slices 1602.

The inspection module 506 also may divide at least the portion 1508 the second inspection signature 1500 into separate, non-overlapping slices 1508 (e.g., slices 1508*a-j*), as shown in FIG. 15. Although ten slices 1508 are shown, optionally, the inspection module 506 may divide at least the portion 1508 into a different number of slices 1508. While the slices 1508 do not overlap each other in FIG. 15, alternatively, one or more of the slices 1508 may overlap one or more other slices 1508. The slices 1508 may horizontally extend along the horizontal axis 1502 for equal distances or time periods. For example, the slices 1508 may have the same width dimensions. Alternatively, one or more of the slices 1508 may have a different width dimension along the horizontal axis than one or more other slices 1508.

The inspection module 506 can correlate the slices 1602, 1508 based on which portions of the route 102 that the slices 1602, 1508 correspond with. For example, different slices 1602 represent the measured characteristics for different segments of the route 102 and different slices 1508 represent the measured characteristics for different segments of the route 102. The inspection module 506 can group the slices 1602, 1508 that represent the measured characteristics over the same segment of the route 102 in the different inspection signatures 1400, 1500 into sets. Each set of the slices 1602, 1508 can include the measured characteristics in the inspection signatures 1400, 1500 for the same segment of the route 102, and different sets of the slices 1602, 1508 may include the measured characteristics in the inspection signatures 1400, 1500 for different segments of the route 102. There may be more than two slices 1602, 1508 in a set, such as when there are three or more inspection signatures for the same segments of the route 102.

For example, the first slices 1602*a*, 1508*a* of the different inspection signatures 1400, 1500 may occur over the same time period or length of route 102, the second slices 1602*b*, 1508*b* of the different inspection signatures 1400, 1500 may occur over the same subsequent time period or length of route 102, the third slices 1602*c*, 1508*c* of the different inspection signatures 1400, 1500 may occur over the same subsequent time period or length of route 102, and so on. The inspection module 506 can compare the slices 1602, 1508 in the same set with each other to confirm or refute the identification of a damaged section of the route 102 (shown in FIG. 1). The inspection module 506 can compare the first slices 1602*a*, 1508*a* with each other, the second slices 1602*b*, 1508*b* with each other, and so on.

In one example of comparing corresponding slices 1602, 1508 with each other, the inspection module 506 may determine if both or all of the slices 1602, 1508 in a set represent measured characteristics of the route 102 that indicates damage to the route 102. The inspection module 506 may determine that both or all of the slices 1602, 1508 in a set represent damage to the route 102 when the measured characteristics of the first and second inspection signatures 1400, 1500 in those compared slices 1602, 1508 are less than a designated threshold. For example, if the inspection signatures 1400, 1500 represent current or voltage conducted through a rail of the route 102, the inspection module 506 can determine that the slices 1602, 1508 listed below fall below designated thresholds 1604, 1510 of the inspection signatures 1400, 1500.

| Slice in inspection signature 1400 | Below threshold 1604? | Slice in inspection signature 1500 | Below threshold 1510? |
|---|---|---|---|
| 1602a | No | 1508a | No |
| 1602b | Yes | 1508b | Yes |
| 1602c | Yes | 1508c | Yes |
| 1602d | No | 1508d | Yes |
| 1602e | Yes | 1508e | Yes |
| 1602f | Yes | 1508f | No |
| 1602g | Yes | 1508g | Yes |
| 1602h | Yes | 1508h | Yes |
| 1602i | No | 1508i | Yes |
| 1602j | No | 1508j | No |

The thresholds 1604, 1510 can represent lower limits on the measured characteristics such that, when the measured characteristics drop below the thresholds 1604, 1510, the characteristics indicate potential damage to the route 102. Optionally, the thresholds 1604, 1510 can represent upper limits on the measured characteristics such that, when the measured characteristics rise above the thresholds 1604, 1510, the characteristics indicate potential damage to the route 102.

In comparing the same slices 1602, 1508, the inspection module 506 can determine if the corresponding slices 1602, 1508 in the sets both or all fall below the thresholds 1604, 1510. If both slices 1602, 1508 in a set fall below the threshold 1604, 1510 (or rise above an upper threshold), then the inspection module 506 can identify or confirm that the segment of the route 102 (in which the measured characteristics of the slices 1602, 1508 were measured) is damaged. On the other hand, if less than all (or less than a designated number) of the slices 1602, 1508 in a set falls below the threshold 1604, 1510 (or rise above an upper threshold), then the inspection module 506 can determine that the segment of the route 102 (in which the measured characteristics of the slices 1602, 1508 were measured) is not damaged (or can refute the potential identification of damage to the route 102. In the example shown above in the tables, the (b), (c), (e), (g), and (h) sets of slices 1602, 1508 exceed the thresholds. Therefore, the inspection module 506 can determine that five of the ten sets of slices 1602, 1508 indicate damage to the route 102. The inspection module 506 can assign a score to these sets, such as a score of five. The inspection module 506 can compare this score to a score threshold, such as a score of four, five, or another number. If the score of the sets meets or exceeds the score threshold, then the inspection module 506 can determine or confirm that the route 102 is damaged. Otherwise, the inspection module 506 may determine that the route 102 is not damaged or refute a previous identification of possible damage to the route 102.

As described above, the sensing system 200 (shown in FIG. 2) may take one or more remedial actions if a section of the route 102 is identified by the identification module 506 as being damaged. In one aspect, the selection of which remedial actions to implement may be based on the score of the sets of slices 1602, 1508 being examined. Different scores can result in different remedial actions being taken. In one aspect, larger scores may result in more severe remedial actions, while smaller scores can result in lesser remedial actions. For example, if the score of the sets of slices 1602, 1508 meets or exceeds a first, relatively large score threshold, then the sensing system 200 may communicate (e.g., broadcast or transmit) a warning to one or more off-board locations (e.g., a dispatch facility, other vehicles or vehicle systems, etc.) to instruct the other locations to no longer use the segment of the route 102 that is identified as being damaged. In one embodiment, the sensing system 200 may additionally communicate a request to one or more off-board locations for repair of the damaged segment of the route 102. If the score of the sets of slices 1602, 1508 does not meet or exceed the first score threshold, but does meet or exceed a smaller, second score threshold, then the sensing system 200 can automatically control slack in the vehicle system 100 until the vehicle system 100 completes travel over the damaged segment of the route 102. If the score of the sets of slices 1602, 1508 does not meet or exceed the second score threshold, but does meet or exceed a smaller, third score threshold, then the sensing system 200 can automatically slow movement of the vehicle system 100. If the score of the sets of slices 1602, 1508 does not meet or exceed the second score threshold, but does meet or exceed a smaller, fourth score threshold, then the sensing system 200 can automatically stop movement. Optionally, one or more other remedial actions can be taken based on the score determined by the inspection module 506.

Figure 17:
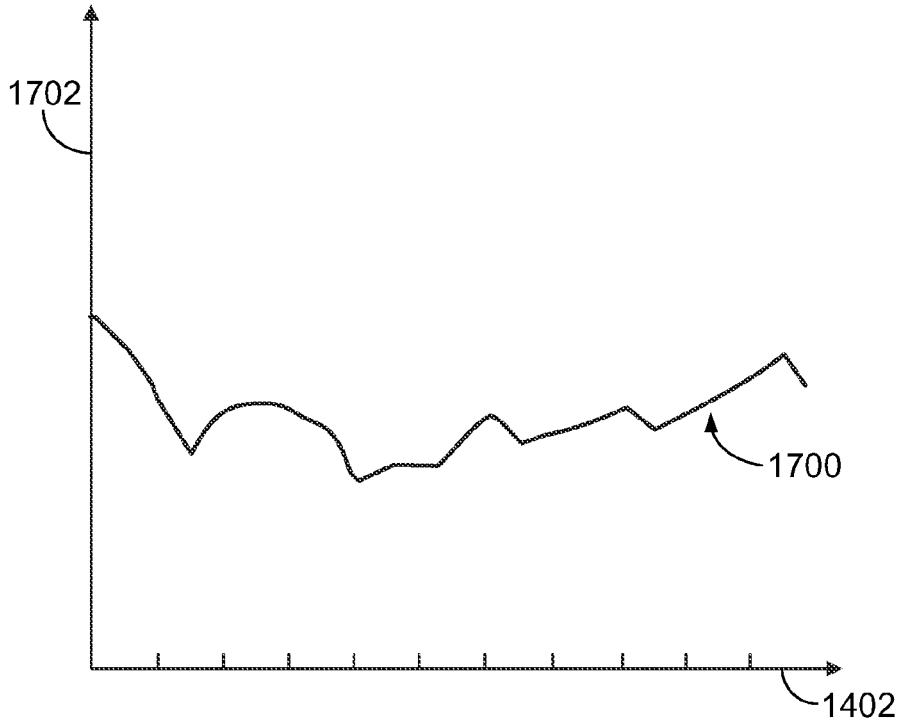
FIG. 17 illustrates a net inspection signature according to one example of the inventive subject matter described herein.

In another aspect, the inspection module 506 can combine the inspection signatures 1400, 1500 with each other to generate a net signature of the route 102 and can determine if the route 102 is damaged based on this net signature. FIG. 17 illustrates a net inspection signature 1700 according to one example of the inventive subject matter described herein. The net inspection signature 1700 represents a combination of the measured characteristics in the inspection signatures 1400, 1500 shown in FIGS. 14 and 15, and is shown alongside the horizontal axis 1402 described above and a vertical axis 1702 representative of magnitudes of the combined measured characteristics of the inspection signatures 1400, 1500.

In one example, the net inspection signature 1700 can be created by adding the measured characteristics of the inspection signature 1400 with the measured characteristics of the inspection signature 1500. Optionally, the net inspection signature 1700 can be created by calculating differences between the measured characteristics of the inspection signature 1400 and the measured characteristics of the inspection signature 1500. In another example, the net inspection signature 1700 may represent the largest or smallest of the measured characteristics in the inspection signatures 1400, 1500 at respective locations along the horizontal axis 1402. Optionally, the net inspection signature 1700 can represent averages, medians, or other calculations of the measured characteristics in the inspection signatures 1400, 1500.

The inspection module 506 (shown in FIG. 5) can generate the net inspection signature 1700 and examine the net inspection signature 1700 to determine if the route 102 is damaged. In one aspect, the inspection module 506 can compare the net inspection signature 1700 to one or more designated thresholds, similar to as described above, to determine if the net inspection signature 1700 indicates damage to the route 102. Depending on whether the net inspection signature 1700 meets or exceeds or falls below (as appropriate) upper or lower thresholds, the inspection module 506 may take one or more remedial actions, also as described above.

The examination of multiple inspection signatures obtained by different sensors 108 of the vehicle system 100 in order to identify damage to the route 102 can reduce the amount of false positive detections of damage to the route 102. For example, the inspection signature generated from the measured characteristics obtained by the leading sensor 108A may indicate damage to the route 102 when there is no damage. This is referred to as a false positive detection of damage to the route 102. If the sensing system 200 only relied on the use of a single inspection signature to take a remedial action (e.g., slowing or stopping the vehicle system 100), then the vehicle system 100 could frequently slow down or stop when no damage to the route 102 actually exists. Instead, using two or more inspection signatures from different sensors 108 can reduce the number of times that damage to the route 102 is identified when no such damage exists.

Figure 18:
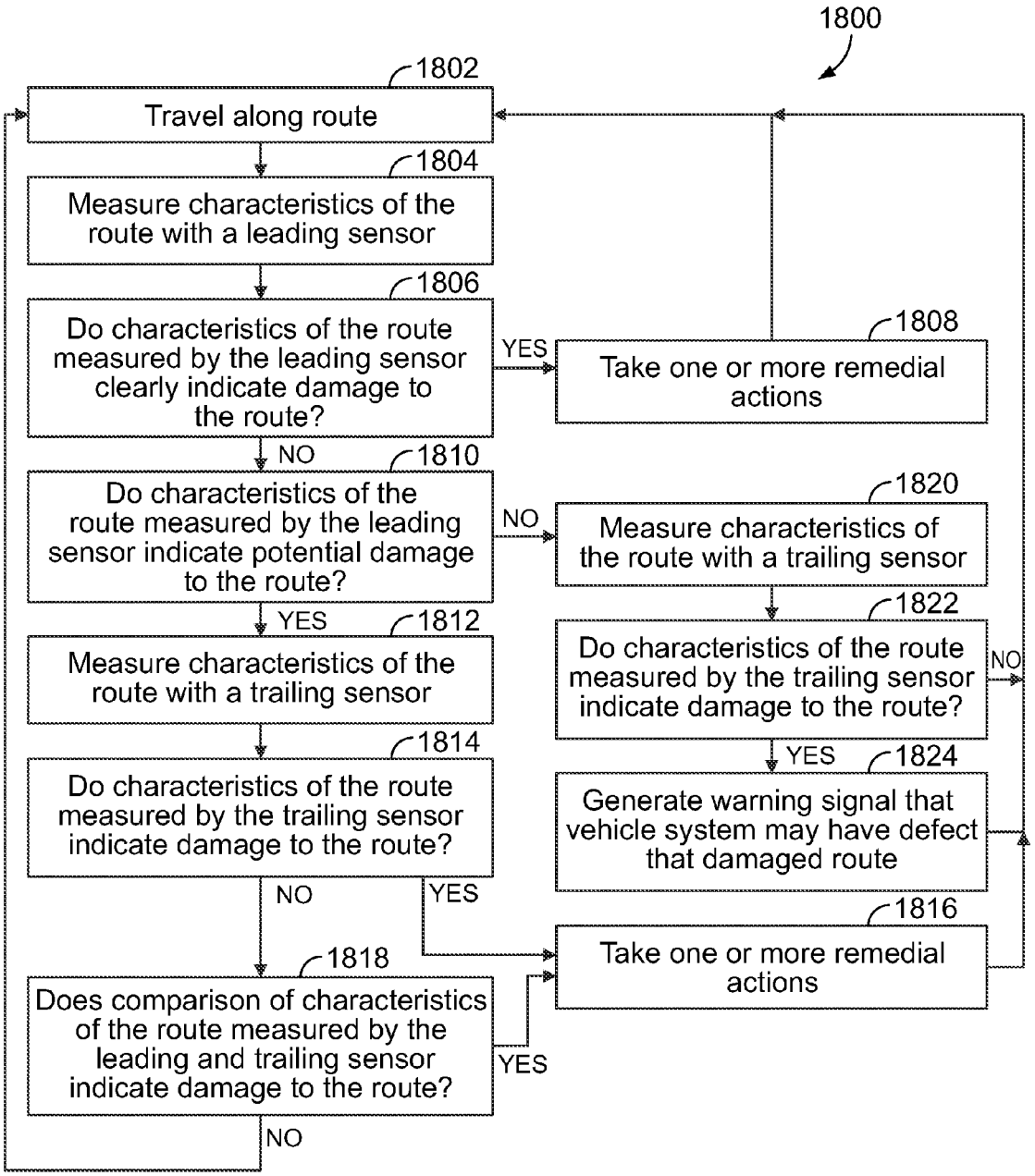
FIG. 18 illustrates a method for inspecting a route for damage according to one example of the inventive subject matter.

FIG. 18 illustrates a method 1800 for inspecting a route for damage according to one example of the inventive subject matter. The method 1800 may be used by the sensing system 200 (shown in FIG. 2) to examine the route 102 (shown in FIG. 1) and determine if the route 102 and/or the vehicle system 100 (shown in FIG. 1) on which the sensing system 200 is disposed is damaged.

At 1802, the vehicle system with the sensing system travels along the route. At 1804, a leading sensor of the sensing system measures characteristics of the route during this travel along the route. As described above, the leading sensor can measure electrical characteristics (e.g., voltage, current, impedance, resistance, or the like) of the route, can obtain ultrasound echoes from the route, can measure physical characteristics (e.g., distances, displacements, or the like) of the route, or other characteristics.

At 1806, a determination is made as to whether the characteristics measured by the leading sensor clearly indicate damage to the route. In one example, the characteristics can be compared to a first upper or lower threshold, or a first range of acceptable values, in order to determine if the characteristics meet or exceed the first upper threshold, fall below the first lower threshold, or otherwise fall outside of the first range of acceptable values. If the measured characteristics do meet or exceed the first upper threshold, fall below the first lower threshold, or otherwise fall outside of the first range, then the measured characteristics obtained by the leading sensor may clearly indicate damage to the route. As a result, flow of the method 1800 can proceed to 1808.

At 1808, one or more remedial actions can be taken in response to identifying the damage in the route. These actions can include, but are not limited to, changing tractive effort and/or braking effort provided by one or more propulsion-generating vehicles in the vehicle system (e.g., locomotives) to control slack in the vehicle system (e.g., to maintain slack between coupled vehicles between designated upper and lower limits), slowing movement of the vehicle system, stopping movement of the vehicle system, directing one or more additional sensors to measure characteristics of the route, communicating messages to off-board locations to request inspection and/or maintenance of the route and/or vehicle system, changing which route the vehicle system is traveling along, and the like. If the remedial action does not involve stopping movement of the vehicle system, then flow of the method 1800 can return to 1802, where the vehicle system continues to travel along the route.

On the other hand, if the characteristics measured by the leading sensor do not clearly indicate damage to the route (e.g., at 1806), then flow of the method 1800 can continue to 1810. At 1810, the characteristics measured by the leading sensor are examined to determine if the characteristics indicate potential damage to the route. The examination of these characteristics at 1806 and 1810 may occur at the same time or at different times. The characteristics can indicate potential damage, but not clear damage, to the route, when the characteristics meet or exceed a second upper threshold that is smaller than the first upper threshold described above, fall below a second lower threshold that is larger than the first lower threshold described above, or extend outside of a second range that is smaller than the first range described above. For example, the measured characteristics may be sufficiently large or small to indicate potential or probable damage, but may not be large or small enough to clearly indicate damage to the route. In such a situation, flow of the method 1800 can proceed to 1812 in order to confirm or refute the identification of potential damage to the route.

If, however, the characteristics measured by the leading sensor do not indicate potential damage to the route, then flow of the method 1800 may proceed to 1820 (described below).

At 1812, a trailing or other sensor of the sensing system measures characteristics of the route during travel along the route. As described above, the trailing sensor can measure electrical characteristics (e.g., voltage, current, impedance, resistance, or the like) of the route, can obtain ultrasound echoes from the route, can measure physical characteristics (e.g., distances, displacements, or the like) of the route, or other characteristics.

At 1814, a determination is made as to whether the characteristics measured by the trailing or other sensor indicate damage to the route. In one example, the characteristics can be compared to the same or different thresholds or ranges as the measured characteristics obtained by the leading sensor. If the measured characteristics of the trailing sensor meet or exceed one or more upper thresholds, fall below one or more lower thresholds, or otherwise fall outside of one or more ranges, then the measured characteristics obtained by the trailing sensor may indicate damage to the route. As a result, the identification of potential damage to the route that is based on the characteristics measured by the leading sensor is confirmed, and flow of the method 1800 can proceed to 1816.

At 1816, one or more remedial actions can be taken in response to identifying the damage in the route. As described above, these actions can include, but are not limited to, changing tractive effort and/or braking effort provided by one or more propulsion-generating vehicles in the vehicle system (e.g., locomotives) to control slack in the vehicle system (e.g., to maintain slack between coupled vehicles between designated upper and lower limits), slowing movement of the vehicle system, stopping movement of the vehicle system, directing one or more additional sensors to measure characteristics of the route, communicating messages to off-board locations to request inspection and/or maintenance of the route and/or vehicle system, changing which route the vehicle system is traveling along, and the like. If the remedial action does not involve stopping movement of the vehicle system, then flow of the method 1800 can return to 1802, where the vehicle system continues to travel along the route.

On the other hand, if the characteristics of the route that are measured by the trailing or other sensor do not indicate damage to the route, then the identification of potential damage to the route that is based on the characteristics measured by the leading or other sensor cannot yet be confirmed. The characteristics measured by the leading (or other) sensor can be compared to the characteristics measured by the trailing (or other) sensor in order to confirm or refute this identification of potential damage to the route. As a result, at 1814, if the characteristics measured by the trailing or other sensor do not confirm the identification of damage to the route, then flow of the method 1800 may proceed to 1818.

At 1818, the characteristics measured by two or more of the sensors (e.g., the leading, trailing, and/or other sensors) are compared to each other to determine if the compared characteristics indicate damage to the route. As described above, the characteristics of one or more sensors may need to be normalized to account for differences in the speed of the vehicle system between the time period when one sensor measured the characteristics and the time period when another sensor measured the characteristics. The characteristics can be compared by dividing inspection signatures of the measured characteristics into slices, and comparing the slices to each other and/or to thresholds to determine scores of the inspection signatures (as described above). If the scores meet or exceed one or more thresholds, then the characteristics measured by the two or more sensors indicate or confirm damage to the route. As a result, flow of the method 1800 can proceed to 1816. Otherwise, the potential damage to the route is not confirmed, and flow of the method 1800 can return to 1802 until a trip of the vehicle system is completed or another ending point in time.

As described above, at 1810, if the characteristics measured by the leading sensor do not indicate potential damage to the route, then flow of the method 1800 may proceed to 1820 (described below). At 1820, a trailing or other sensor of the sensing system measures characteristics of the route during travel along the route. As described above, the trailing sensor can measure electrical characteristics (e.g., voltage, current, impedance, resistance, or the like) of the route, can obtain ultrasound echoes from the route, can measure physical characteristics (e.g., distances, displacements, or the like) of the route, or other characteristics.

At 1822, a determination is made as to whether the characteristics measured by the trailing or other sensor indicate damage to the route. In one example, the characteristics can be compared to the same or different thresholds or ranges as the measured characteristics obtained by the leading sensor. If the measured characteristics of the trailing sensor meet or exceed one or more upper thresholds, fall below one or more lower thresholds, or otherwise fall outside of one or more ranges, then the measured characteristics obtained by the trailing sensor may indicate damage to the route. As a result, potential damage to the route may be identified, even though the characteristics measured by the leading sensor do not indicate damage to the route. As a result, flow of the method 1800 can proceed to 1824.

On the other hand, if the characteristics measured by the trailing sensor do not indicate damage to the route, flow of the method 1800 can return to 1802 until a trip of the vehicle system is completed or another ending point in time.

At 1824, a warning signal is generated to indicate that the vehicle system may have damaged the route. For example, because no damage was identified by the characteristics measured by the leading sensor, but damage was identified by the characteristics measured by the trailing sensor, the damage to the route may have occurred after the leading sensor passed over the now damaged section of the route, but before the trailing sensor reached this location. The warning signal may cause a warning to be displayed onboard to the operator so that the operator can take one or more remedial actions described herein, or can cause the vehicle system to automatically take one or more remedial actions described herein.

In one aspect of the inventive subject matter described herein, a vehicle system (such as a rail vehicle consist) can have onboard track inspection equipment (e.g., a leading sensor) on a lead or other locomotive in the vehicle system. When this equipment crosses over a section of track and the equipment detects an issue (e.g., damage to the track), or needs a better check (e.g., identifies potential damage to the track), a message may be communicated from the equipment on the lead locomotive to track inspection equipment onboard one or more other locomotives (e.g., one or more trailing sensors). The message may be communicated using Distributed Power or Ethernet over multiple unit (MU) cable technology. Distributed Power is a technology that, among other things, allows locomotives in a consist or train to coordinate their tractive and/or braking efforts. Ethernet over MU cable technology allows for the communication of network data (e.g., packetized data) or other data through the MU cable extending through the vehicle consist. This message can trigger the track inspection equipment onboard one or more other locomotives to look more closely at this section of track (e.g., examine the area of track where the leading equipment identified potential damage). The trailing equipment can accomplish this by recording details about the track with greater precision than the sensors of the trailing equipment are normally configured for. For example, the sensors may have a default or standard resolution (e.g., quantifiable amount of data acquired per unit time, per unit area, or per unit length of track). These sensors may not be able to measure characteristics of the track at higher resolutions (e.g., larger amounts of data acquired per unit time, per unit area, or per unit length of track) due to limits on the memory available to the sensors. But, the resolution of these sensors may be increased subsequent or responsive to leading equipment (e.g., sensor) identifying potential damage to the track.

In one example of the inventive subject matter described herein, a sensing system includes a leading sensor, a trailing sensor, and a route examining unit. The leading sensor is configured to be coupled to a leading rail vehicle of a rail vehicle system that travels along a track. The leading sensor also is configured to acquire first inspection data indicative of a condition of the track in an examined section of the track as the rail vehicle system travels over the track. The trailing sensor is configured to be coupled to a trailing rail vehicle of the rail vehicle system and to acquire additional, second inspection data indicative of the condition of the track subsequent to the leading rail vehicle passing over the examined section of the track and the leading sensor acquiring the first inspection data. The route examining unit is configured to be disposed onboard the rail vehicle system. The route examining unit also is configured to direct the trailing sensor to acquire the second inspection data in the examined section of the track when the first inspection data indicates damage to the track such that both the leading sensor and the trailing sensor acquire the first inspection data and the second inspection data, respectively, of the examined section of the track during a single pass of the rail vehicle system over the examined section of the track. The leading sensor can be configured to acquire the first inspection data at a first resolution level and the trailing sensor can be configured to acquire the second inspection data at a second resolution level that is greater than the first resolution level such that the second inspection data includes a greater amount of data than the first inspection data at least one of per unit time, per unit distance, or per unit area.

In one aspect, at least one of the route examining unit or the trailing sensor is configured to select the second resolution level, from among a plurality of available sensor resolution levels, based on at least one of a current speed of the vehicle system, a category of the damage, or a degree of the damage.

In one aspect, the leading rail vehicle and the trailing rail vehicle are locomotives mechanically interconnected with each other by one or more railcars in the vehicle system.

In one aspect, the first inspection data acquired by the leading sensor and the second inspection data acquired by the trailing sensor are different types of inspection data, with at least one of the types of inspection data being non-optical inspection data.

In one aspect, the trailing sensor is configured to acquire the second inspection data responsive to the route examining unit determining that the first inspection data indicates the damage to the track.

In one aspect, the route examining unit is configured to direct a controller of the vehicle system to at least one of autonomously control the rail vehicle system or direct an operator of the rail vehicle system to decrease slack in one or more coupler devices that couple the trailing rail vehicle with one or more other vehicles in the vehicle system when the first inspection data indicates the damage to the track and prior to the trailing sensor traveling over the damage to the track.

In another example of the inventive subject matter described herein, a sensing system includes a leading sensor, a trailing sensor, and a route examining unit. The leading sensor is configured to be coupled to a leading rail vehicle of a rail vehicle system that travels along a track. The leading sensor also is configured to automatically acquire first inspection data indicative of a condition of the track in an examined section of the track as the rail vehicle system travels over the track. The first inspection data can be acquired at a first resolution level. The trailing sensor is configured to be coupled to a trailing rail vehicle of the rail vehicle system and to automatically acquire additional, second inspection data indicative of the condition of the track subsequent to the leading rail vehicle passing over the examined section of the track and the leading sensor acquiring the first inspection data. The second inspection data can be acquired at a second resolution level that is greater than the first resolution level such that the second inspection data includes a greater amount of data than the first inspection data at least one of per unit time, per unit distance, or per unit area. The leading rail vehicle and the trailing rail vehicle can be directly or indirectly mechanically connected in the rail vehicle system. The route examining unit is configured to be disposed onboard the rail vehicle system. The route examining unit also can be configured to automatically direct the trailing sensor to acquire the second inspection data in the examined section of the track when the first inspection data indicates damage to the track such that both the leading sensor and the trailing sensor acquire the first inspection data and the second inspection data, respectively, of the examined section of the track during a single pass of the rail vehicle system over the examined section of the track.

In one aspect, the leading rail vehicle and the trailing rail vehicle are locomotives mechanically interconnected with each other by one or more railcars in the vehicle system.

In one aspect, the first inspection data acquired by the leading sensor and the second inspection data acquired by the trailing sensor are different types of inspection data, with at least one of the types of inspection data being non-optical inspection data.

In one aspect, the trailing sensor is configured to acquire the second inspection data responsive to the route examining unit determining that the first inspection data indicates the damage to the track.

In one aspect, the route examining unit is configured to direct a controller of the vehicle system to at least one of autonomously control the rail vehicle system or direct an operator of the rail vehicle system to decrease slack in one or more coupler devices that couple the trailing rail vehicle with one or more other vehicles in the vehicle system when the first inspection data indicates the damage to the track and prior to the trailing sensor traveling over the damage to the track.

In another example of the inventive subject matter described herein, a sensing system includes a leading sensor, a trailing sensor, and a route examining unit. The leading sensor is configured to be disposed onboard a first vehicle of a vehicle system that travels along a route. The leading sensor also is configured to measure first characteristics of the route as the vehicle system travels along the route. The trailing sensor is configured to be disposed onboard a second vehicle of the vehicle system that is directly or indirectly mechanically coupled with the first vehicle. The trailing sensor also is configured to measure second characteristics of the route as the vehicle system. The route examining unit is configured to be disposed onboard a vehicle system that travels along a route. The route examining unit is configured to receive the first characteristics of the route and the second characteristics of the route and to compare the first characteristics with the second characteristics, the route examining unit also configured to identify a segment of the route as being damaged based on a comparison of the first characteristics with the second characteristics.

In one aspect, the route examining unit is configured to compare a first inspection signature representative of the first characteristics of the route at one or more of different times or locations along the route with a second inspection signature that is representative of the second characteristics of the route at the one or more of different times or locations along the route to identify the segment of the route as being damaged.

In one aspect, the route examining unit is configured to normalize at least one of the first inspection signature or the second inspection signature with respect to at least one of time or distance by modifying at least one of a time scale or a distance scale of the at least one of the first characteristics or the second characteristics prior to comparing the first inspection signature with the second inspection signature.

In one aspect, the route examining unit is configured to normalize the at least one of the first inspection signature or the second inspection signature by expanding or contracting the at least one of a time scale or distance scale of at least a portion of the at least one of the first inspection signature or the second inspection signature.

In one aspect, the route examining unit is configured to separate the first inspection signature into plural first slices and to separate the second inspection signature into plural second slices, and to compare the first slices with the second slices in order to identify the segment of the route as being damaged.

In one aspect, the first slices of the first inspection signature extend over at least one of same time periods or same distances along the route as the second slices of the second inspection signature.

In one aspect, the route examining unit is configured to compare the first slices with the second slices based on which segment along the route that each of the first slices includes the first characteristics measured in the segment and that each of the second slices includes the second characteristics measured in the segment.

In one aspect, the route examining unit is configured to calculate a score representative of how many of the first slices includes the first characteristics that indicate damage to the route in the same segment as the second slices that include the second characteristics that also indicate the damage to the route in the same segment.

In one aspect, the route examining unit is configured to select a remedial action to implement responsive to identifying the damage in the route based on the score that is calculated.

In another embodiment, a sensing system is provided that includes a leading sensor, a trailing sensor, and a route examining unit. The leading sensor is configured to be coupled to a vehicle system that travels along a route. The leading sensor also is configured to acquire first inspection data indicative of a condition of the route as the vehicle system travels over the route. The condition may represent the health (e.g., damaged or not damaged, a degree of damage, and the like) of the route. The trailing sensor is configured to be coupled to the vehicle system and to acquire additional, second inspection data that is indicative of the condition to the route subsequent to the leading sensor acquiring the first inspection data. The route examining unit is configured to be disposed onboard the vehicle system and to identify a section of interest in the route based on the first inspection data acquired by the leading sensor. The route examining unit also is configured to direct the trailing sensor to acquire the second inspection data within the section of interest in the route when the first inspection data indicates damage to the route in the section of interest.

In one aspect, the leading sensor is configured to be coupled with and acquire the first inspection data from a leading vehicle in the vehicle system and the trailing sensor is configured to be coupled with and acquire the second inspection data from a trailing vehicle in the vehicle system. The leading vehicle and the trailing vehicle are mechanically directly or indirectly interconnected with each other in the vehicle system such that, in at least one direction of travel of the vehicle system, the leading vehicle travels over the section of interest in the route before the trailing vehicle.

In one aspect, the leading sensor and the trailing sensor may be coupled to the same vehicle in the vehicle system.

In one aspect, the leading sensor is configured to acquire the first inspection data and the trailing sensor is configured to acquire the second inspection data during a single pass of the vehicle system over the section of interest in the route.

In one aspect, the first inspection data acquired by the leading sensor and the additional inspection data acquired by the trailing sensor are different types of inspection data.

In one aspect, the leading sensor is configured to acquire the first inspection data at a lower resolution level and the trailing sensor is configured to acquire the second inspection data at a greater resolution level. The resolution levels may represent how much inspection data is acquired per unit time, an amount of inspection data that is acquired during a pass of the respective sensor over the section of interest in the route, and the like.

In one aspect, the leading sensor is configured to be coupled to a leading locomotive and the trailing sensor is configured to be coupled to a trailing locomotive of the vehicle system.

In one aspect, the trailing sensor is configured to acquire the second inspection data responsive to the route examining unit determining that the first inspection data indicates the damage to the route.

In one aspect, the trailing sensor is configured to acquire the second inspection data only when the route examining unit determines that the first inspection data indicates the damage to the route.

In one aspect, the route examining unit is configured to determine when to direct the trailing sensor to begin acquiring the second inspection data based on a velocity of the vehicle system and a separation distance between the leading sensor and the trailing sensor.

In one aspect, the route examining unit is configured to communicate with a location determination system of the vehicle system to determine a location of the section of interest in the route and to direct the trailing sensor to being acquiring the second inspection data based on a velocity of the vehicle system and the location of the section of interest.

In one aspect, the route examining unit is configured to direct a controller of the vehicle system to at least one of autonomously control the vehicle system or direct an operator of the vehicle system to slow the vehicle system down upon determination that the first inspection data indicates damage to the route. The controller may be an onboard processing device that controls operations of the vehicle system or at least one of the vehicles.

In one aspect, the route examining unit is configured to direct a controller of the vehicle system to at least one of autonomously control the vehicle system or direct the operator such that the vehicle system travels faster over the section of interest when the leading sensor passes over the section of interest than when the trailing sensor passes over the section of interest. The controller may be an onboard processing device that controls operations of the vehicle system or at least one of the vehicles.

In one aspect, the route examining unit is configured to direct a controller of the vehicle system to at least one of autonomously control the vehicle system or direct an operator of the vehicle system to reduce slack in one or more coupler devices of the vehicle system between the trailing vehicle and one or more other vehicles in the vehicle system when the first inspection data indicates the damage to the route. The controller may be an onboard processing device that controls operations of the vehicle system or at least one of the vehicles.

In one aspect, the route examining unit is configured to transmit a notification signal to an off-board location responsive to identification of damage to the route based on one or more of the first inspection data and/or the second inspection data, the notification signal notifying the off-board location of at least one of a location of the damage to the route and/or a type of damage to the route.

In one aspect, the route examining unit is configured to transmit a warning signal to one or more other vehicles or vehicle systems responsive to identification of damage to the route based on one or more of the first inspection data and/or the second inspection data, the warning signal notifying the one or more other vehicles or vehicle systems of at least one of a location of the damage to the route and/or a type of damage to the route.

In another embodiment, a method (e.g., for acquiring inspection data of a route) includes acquiring first inspection data indicative of a condition of a route from a leading sensor coupled to a leading vehicle in a vehicle system as the vehicle system travels over the route, determining that the first inspection data indicates damage to the route in a section of interest in the route, and directing a trailing sensor coupled to a trailing vehicle of the vehicle system to acquire additional, second inspection data of the route when the first inspection data indicates the damage to the route. The leading vehicle and the trailing vehicle are mechanically directly or indirectly interconnected with each other in the vehicle system such that the leading vehicle passes over the section of interest of the route before the trailing vehicle.

In one aspect, acquiring the first inspection data and directing the trailing sensor to acquire the second inspection data occurs such that both the first inspection data and the second inspection data are acquired during a single pass of the vehicle system over the section of interest in the route.

In one aspect, the first inspection data acquired by the leading sensor and the second inspection data acquired by the trailing sensor are different types of inspection data.

In one aspect, acquiring the first inspection data is acquired at a first resolution level and the second inspection data is acquired at a second resolution level that is greater than the first resolution level. The resolution levels may represent how much inspection data is acquired per unit time, an amount of inspection data that is acquired during a pass of the respective sensor over the section of interest in the route, and the like.

In one aspect, directing the trailing sensor to acquire the second inspection data includes directing the trailing sensor when to acquire the second inspection data based on a velocity of the vehicle system and a separation distance between the leading sensor and the trailing sensor.

In one aspect, the method also includes slowing movement of the vehicle system responsive to determining that the first inspection data indicates the damage to the route.

In one aspect, the method also includes reducing slack in one or more coupler devices between the trailing vehicle and one or more other vehicles in the vehicle system responsive to determining that the first inspection data indicates the damage to the route.

In another embodiment, a sensing system includes a leading sensor, a trailing sensor, and a route examining unit. The leading sensor is configured to be coupled to a leading rail vehicle of a rail vehicle system that travels along a track. The leading sensor also is configured to acquire first inspection data indicative of a condition of the track in an examined section of the track as the rail vehicle system travels over the track. The trailing sensor is configured to be coupled to a trailing rail vehicle of the rail vehicle system and to acquire additional, second inspection data indicative of the condition to the track subsequent to the leading rail vehicle passing over the examined section of the track and the leading sensor acquiring the first inspection data. The route examining unit is configured to be disposed onboard the rail vehicle system. The route examining unit also is configured to direct the trailing sensor to acquire the second inspection data in the examined section of the track when the first inspection data indicates damage to the track such that both the leading sensor and the trailing sensor acquire the first inspection data and the second inspection data, respectively, of the examined section of the track during a single pass of the rail vehicle system over the examined section of the track.

In one aspect, the leading rail vehicle and the trailing rail vehicle are locomotives mechanically interconnected with each other by one or more railcars in the vehicle system.

In one aspect, the first inspection data acquired by the leading sensor and the second inspection data acquired by the trailing sensor are different types of inspection data.

In one aspect, the leading sensor is configured to acquire the first inspection data at a first resolution level and the trailing sensor is configured to acquire the second inspection data at a second resolution level that is greater than the first resolution level.

In one aspect, at least one of the route examining unit or the trailing sensor is configured to select the second resolution level, from among a plurality of available sensor resolution levels, based on at least one of a current speed of the vehicle system, a category of the damage, or a degree of the damage.

In one aspect, the trailing sensor is configured to acquire the second inspection data responsive to the route examining unit determining that the first inspection data indicates the damage to the track.

In one aspect, the route examining unit is configured to direct a controller of the vehicle system to at least one of autonomously control the rail vehicle system or direct an operator of the rail vehicle system to slow movement of the rail vehicle system down upon determination that the first inspection data indicates damage to the track. The controller may be an onboard processing device that controls operations of the vehicle system or at least one of the vehicles.

In one aspect, the route examining unit is configured to direct a controller of the vehicle system to at least one of autonomously control the rail vehicle system or direct an operator of the rail vehicle system to decrease slack in one or more coupler devices that couple the trailing rail vehicle with one or more other vehicles in the vehicle system when the first inspection data indicates the damage to the track. The controller may be an onboard processing device that controls operations of the vehicle system or at least one of the vehicles.

In one aspect, a sensing system comprises a leading sensor configured to be coupled to a leading rail vehicle of a rail vehicle system that travels along a track. The leading sensor is also configured to automatically acquire first inspection data indicative of a condition of the track in an examined section of the track as the rail vehicle system travels over the track. The first inspection data is acquired at a first resolution level. The sensing system further comprises a trailing sensor configured to be coupled to a trailing rail vehicle of the rail vehicle system and to automatically acquire additional, second inspection data indicative of the condition of the track subsequent to the leading rail vehicle passing over the examined section of the track and the leading sensor acquiring the first inspection data. The second inspection data is acquired at a second resolution level that is greater than the first resolution level. The leading rail vehicle and the trailing rail vehicle are directly or indirectly mechanically connected in the rail vehicle system. The sensing system further includes a route examining unit configured to be disposed onboard the rail vehicle system. The route examining unit is also configured to automatically direct the trailing sensor to acquire the second inspection data in the examined section of the track when the first inspection data indicates damage to the track, such that both the leading sensor and the trailing sensor acquire the first inspection data and the second inspection data, respectively, of the examined section of the track during a single pass of the rail vehicle system over the examined section of the track. In one aspect, the rail vehicle system may be a train, and the leading rail vehicle and the trailing rail vehicle may be first and second locomotives of the train.

In another embodiment, a sensing system includes a route examining unit that is configured to be disposed onboard a vehicle system that travels along a route. The route examining unit also is configured to receive first inspection data from a leading sensor configured to be coupled to a leading vehicle of the vehicle system as the vehicle system travels over the route. The first inspection data is indicative of a condition of the route in an examined section of the route. The route examining unit is further configured to identify damage in the examined section of the route based on the first inspection data and to direct a trailing sensor to acquire second inspection data in the examined section of the route responsive to identifying the damage. The trailing sensor is configured to be coupled to a trailing vehicle of the vehicle system that is indirectly or directly mechanically coupled to the leading vehicle.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A sensing system comprising:

a leading sensor configured to be coupled to a leading rail vehicle of a rail vehicle system that travels along a track, the leading sensor also configured to acquire first inspection data indicative of a condition of the track in an examined section of the track as the rail vehicle system travels over the track;

a trailing sensor configured to be coupled to a trailing rail vehicle of the rail vehicle system and to acquire additional, second inspection data indicative of the condition of the track subsequent to the leading rail vehicle passing over the examined section of the track and the leading sensor acquiring the first inspection data; and a route examining unit configured to be disposed onboard the rail vehicle system, the route examining unit also configured to direct the trailing sensor to acquire the second inspection data in the examined section of the track when the first inspection data indicates damage to the track such that both the leading sensor and the trailing sensor acquire the first inspection data and the second inspection data, respectively, of the examined section of the track during a single pass of the rail vehicle system over the examined section of the track, wherein the leading sensor is configured to acquire the first inspection data at a first resolution level and the trailing sensor is configured to acquire the second inspection data at a second resolution level that is greater than the first resolution level such that the second inspection data includes a greater amount of data than the first inspection data at least one of per unit time, per unit distance, or per unit area.

2. The sensing system of claim 1, wherein at least one of the route examining unit or the trailing sensor is configured to select the second resolution level, from among a plurality of available sensor resolution levels, based on at least one of a current speed of the vehicle system, a category of the damage, or a degree of the damage.

3. The sensing system of claim 1, wherein the leading rail vehicle and the trailing rail vehicle are locomotives mechanically interconnected with each other by one or more railcars in the vehicle system.

4. The sensing system of claim 1, wherein the first inspection data acquired by the leading sensor and the second inspection data acquired by the trailing sensor are different types of inspection data, with at least one of the types of inspection data being non-optical inspection data.

5. The sensing system of claim 1, wherein the trailing sensor is configured to acquire the second inspection data responsive to the route examining unit determining that the first inspection data indicates the damage to the track.

6. The sensing system of claim 1, wherein the route examining unit is configured to direct a controller of the vehicle system to at least one of autonomously control the rail vehicle system or direct an operator of the rail vehicle system to decrease slack in one or more coupler devices that couple the trailing rail vehicle with one or more other vehicles in the vehicle system when the first inspection data indicates the damage to the track and prior to the trailing sensor traveling over the damage to the track.

7. The sensing system of claim 1, wherein the route examining unit is configured to identify the damage to the route by comparing a first inspection signature representative of changes in magnitudes of the first inspection data with respect to one or more of time or distance along the route with a second inspection signature representative of changes in magnitudes of the second inspection data with respect to the one or more of time or distance along the route.

8. The sensing system of claim 7, wherein the route examining unit is configured to compare the first inspection signature with the second inspection signature to identify the damage to the route by normalizing one or more of the first inspection signature or the second inspection signature by one or more of expanding or contracting one or more of a time scale or a distance scale of the one or more of the first inspection signature or the second inspection signature, dividing two or more of the first inspection signature, the second inspection signature, or the one or more of the first inspection signature or the second inspection signature that is normalized into smaller signature portions, temporally or spatially correlating the smaller signature portions obtained from the two or more of the first inspection signature, the second inspection signature, or the one or more of the first inspection signature or the second inspection signature that is normalized with each other, and comparing the smaller signature portions obtained from at least one of the first inspection signature, the second inspection signature, or the one or more of the first inspection signature or the second inspection signature that is normalized with the smaller signature portions obtained from at least another one of the first inspection signature, the second inspection signature, or the one or more of the first inspection signature or the second inspection signature that is normalized.

9. The sensing system of claim 7, wherein the route examining unit is configured to combine the first inspection signature with the second inspection signature to form a net inspection signature of the route, wherein the route examining unit is configured to identify the damage to the route based on the net inspection signature.

10. The sensing system of claim 9, wherein the route examining unit is configured to combine the first inspection signature with the second inspection signature such that the net inspection signature represents sums of the first characteristics in the first inspection signature and the second characteristics in the second inspection signature.

11. The sensing system of claim 9, wherein the route examining unit is configured to combine the first inspection signature with the second inspection signature such that the net inspection signature represents differences between the first characteristics in the first inspection signature and the second characteristics in the second inspection signature.

12. The sensing system of claim 1, wherein one or more of the leading sensor or the trailing sensor include an acoustic pick up device configured to measure acoustics of the route as one or more of the first characteristics of the first inspection signature or the second characteristics of the second inspection signature.

13. The sensing system of claim 12, wherein the route examining unit is configured to determine one or more of the first inspection signature or the second inspection signature as a frequency spectrum of the acoustics of the route.

14. The sensing system of claim 1, wherein one or more of the leading sensor or the trailing sensor include a receiver configured to receive light reflected off of the route and the route examining unit is configured to determine one or more of the first inspection signature or the second inspection signature based on the light that is received by the receiver.

15. A sensing system comprising:

a leading sensor configured to be coupled to a leading rail vehicle of a rail vehicle system that travels along a track, the leading sensor also configured to automatically acquire first inspection data indicative of a condition of the track in an examined section of the track as the rail vehicle system travels over the track, wherein the first inspection data is acquired at a first resolution level;

a trailing sensor configured to be coupled to a trailing rail vehicle of the rail vehicle system and to automatically acquire additional, second inspection data indicative of the condition of the track subsequent to the leading rail vehicle passing over the examined section of the track and the leading sensor acquiring the first inspection data, wherein the second inspection data is acquired at a second resolution level that is greater than the first resolution level such that the second inspection data includes a greater amount of data than the first inspection data at least one of per unit time, per unit distance, or per unit area, and wherein the leading rail vehicle and the trailing rail vehicle are directly or indirectly mechanically connected in the rail vehicle system; and a route examining unit configured to be disposed onboard the rail vehicle system, the route examining unit also configured to automatically direct the trailing sensor to acquire the second inspection data in the examined section of the track when the first inspection data indicates damage to the track such that both the leading sensor and the trailing sensor acquire the first inspection data and the second inspection data, respectively, of the examined section of the track during a single pass of the rail vehicle system over the examined section of the track.

16. The sensing system of claim 15, wherein the leading rail vehicle and the trailing rail vehicle are locomotives mechanically interconnected with each other by one or more railcars in the vehicle system.

17. The sensing system of claim 15, wherein the first inspection data acquired by the leading sensor and the second inspection data acquired by the trailing sensor are different types of inspection data, with at least one of the types of inspection data being non-optical inspection data.

18. The sensing system of claim 15, wherein the trailing sensor is configured to acquire the second inspection data responsive to the route examining unit determining that the first inspection data indicates the damage to the track.

19. The sensing system of claim 15, wherein the route examining unit is configured to direct a controller of the vehicle system to at least one of autonomously control the rail vehicle system or direct an operator of the rail vehicle system to decrease slack in one or more coupler devices that couple the trailing rail vehicle with one or more other vehicles in the vehicle system when the first inspection data indicates the damage to the track and prior to the trailing sensor traveling over the damage to the track.

20. A sensing system comprising:

a leading sensor configured to be disposed onboard a first vehicle of a vehicle system that travels along a route, the leading sensor also configured to measure first characteristics of the route as the vehicle system travels along the route;

a trailing sensor configured to be disposed onboard a second vehicle of the vehicle system that is directly or indirectly, mechanically coupled with the first vehicle, the trailing sensor also configured to measure second characteristics of the route as the vehicle system moves along the route; and a route examining unit configured to be disposed onboard the vehicle system, wherein the route examining unit is configured to receive the first characteristics of the route and the second characteristics of the route and to compare a first inspection signature with a second inspection signature, the first inspection signature representative of changes in magnitudes of the first characteristics at different first times, the second inspection signature representative of changes in magnitudes of the second characteristics at different second times, the route examining unit configured to combine the first inspection signature with the second inspection signature to form a net inspection signature of the route, wherein the route examining unit also is configured to identify a segment of the route as being damaged based on the net inspection signature of the route.

21. The sensing system of claim 20, wherein the route examining unit is configured to combine the first inspection signature with the second inspection signature to form the net inspection signature of the route such that the net inspection signature represents sums of the first characteristics in the first inspection signature and the second characteristics in the second inspection signature.

22. The sensing system of claim 20, wherein the route examining unit is configured to combine the first inspection signature with the second inspection signature to form the net inspection signature of the route such that the net inspection signature represents differences between the first characteristics in the first inspection signature and the second characteristics in the second inspection signature.

23. The sensing system of claim 20, wherein one or more of the leading sensor or the trailing sensor include a receiver configured to receive light reflected off of the route and the route examining unit is configured to determine one or more of the first inspection signature or the second inspection signature based on the light that is received by the receiver.

* * * * *